US008187035B2

(12) United States Patent
Davis et al.

(10) Patent No.: US 8,187,035 B2
(45) Date of Patent: May 29, 2012

(54) CONNECTOR ASSEMBLY

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 68 days.

(21) Appl. No.: 12/790,246

(22) Filed: May 28, 2010

(65) Prior Publication Data

US 2011/0294346 A1 Dec. 1, 2011

(51) Int. Cl.
*H01R 13/648* (2006.01)

(52) U.S. Cl. ..... 439/607.02

(58) Field of Classification Search ..... 439/607.01, 439/607.05, 101, 579, 374, 296, 631, 350–358
See application file for complete search history.

(56) References Cited

U.S. PATENT DOCUMENTS 5,184,965 A * 2/1993 Myschik et al. ..... 439/578
5,194,020 A * 3/1993 Voltz ..... 439/579
6,551,126 B1 * 4/2003 Feldman ..... 439/482
7,607,944 B2 * 10/2009 Yoshioka et al. ..... 439/579
7,927,144 B2 * 4/2011 Feldman et al. ..... 439/607.05
2007/0155241 A1 7/2007 Lappohn
2007/0197095 A1 * 8/2007 Feldman et al. ..... 439/608
2010/0048058 A1 2/2010 Morgan
2010/0062629 A1 * 3/2010 Feldman et al. ..... 439/219

FOREIGN PATENT DOCUMENTS

WO WO 2008/156850 A2 12/2008

OTHER PUBLICATIONS

European Search Report, European Application No. EP 11 16 7772, International Filing Date May 26, 2011.

* cited by examiner

*Primary Examiner* — Jean F Duverne

(57) ABSTRACT

A connector assembly includes contact modules each having a dielectric body and plurality of contacts. The dielectric body includes windows internal of the dielectric body and located between adjacent contacts. Holders support corresponding contact modules and the holders are coupled together such that the contact modules are stacked parallel to one another. The holders are electrically grounded and include a support wall and tabs extending outward from the support wall. The contact modules are coupled to the holders such that the tabs are received in the windows to provide shielding within the contact modules.

20 Claims, 14 Drawing Sheets

CONNECTOR ASSEMBLY

BACKGROUND OF THE INVENTION

The subject matter herein relates generally to connector assemblies, and more particularly, to shielded connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase. known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, the shielding is selectively utilized along the signal paths, where portions of the signal paths remain unshielded.

A need remains for an electrical system that provides efficient shielding to meet particular performance demands.

BRIEF DESCRIPTION OF THE INVENTION

In one embodiment, a connector assembly is provided that includes contact modules each having a dielectric body and plurality of contacts. The dielectric body includes windows internal of the dielectric body and located between adjacent contacts. Holders support corresponding contact modules and the holders are coupled together such that the contact modules are stacked parallel to one another. The holders are electrically grounded and include a support wall and tabs extending outward from the support wall. The contact modules are coupled to the holders such that the tabs are received in the windows to provide shielding within the contact modules.

In another embodiment, a connector assembly is provided including contact modules each having a dielectric body with a mating end and a mounting end. The contact modules each have a plurality of contacts with mating portions extending from the mating end. The dielectric body includes windows internal of the dielectric body and located between adjacent contacts. Holders support corresponding contact modules and are electrically grounded, the holders have a support wall and tabs extending outward from the support wall. The contact modules are coupled to the holders such that the tabs are received in the Windows to position the contact modules with respect to the holders. The tabs provide electrical shielding within the contact modules. The holders are ganged together such that the contact modules are stacked parallel to one another. The connector assembly also includes a mating housing coupled to the mating ends of adjacent contact modules such that the mating housing spans across the mating ends of adjacent contact modules. The mating housing has contact channels receiving the mating portions of the corresponding contact modules.

In a further embodiment, a connector system is provided that includes a header assembly and a receptacle assembly. The header assembly includes header holders and header contact modules supported by the header holders. Each header contact module has a dielectric body and plurality of contacts. Each header holder has a support wall and outer walls extending from the support wall to define at least one header chamber. Each header chamber receives a corresponding header contact module, where the header chamber is electrically shielded by the support wall and outer wall. The header holders are coupled together such that the header contact modules are stacked parallel to one another. The header holders define a loading chamber at a front end of the header assembly. The receptacle assembly includes receptacle holders and receptacle contact modules supported by the receptacle holders. Each receptacle contact module has a dielectric body and a plurality of contacts. Each receptacle holder has a support wall and outer walls extending from the support wall to define at least one receptacle chamber. Each receptacle chamber receives a corresponding receptacle module and is electrically shielded by the support wall and outer walls. The receptacle holders are coupled together such that the receptacle contact modules are stacked parallel to one another. The receptacle assembly has a mating housing at a front end of the receptacle assembly, where the mating housing has contact channels that receive the contacts of the receptacle contact module.

DETAILED DESCRIPTION OF THE INVENTION

Figure 1:
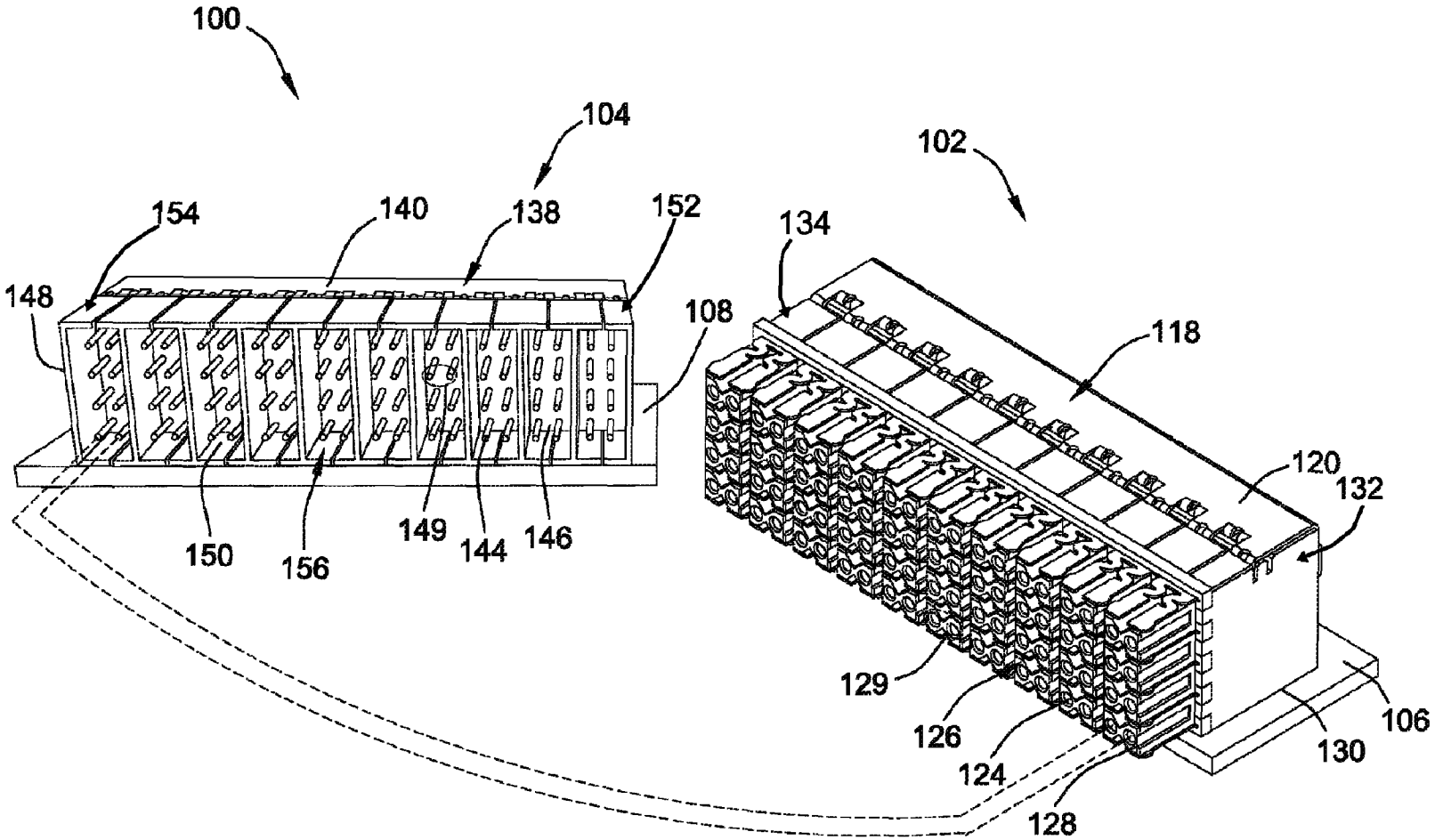
FIG. 1 is a perspective view of a connector system showing a header assembly and receptacle assembly.

FIG. 1 is a perspective view of an exemplary embodiment of a connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented coplanar to one another when the receptacle and header assemblies 102, 104 are mated. Alternative orientations of the circuit boards 106, 108 are possible in alternative embodiments. For example, the circuit boards 106, 108 may be parallel to one another, but non-coplanar with respect to one another. In some alternative embodiments, the circuit boards 106, 108 may be perpendicular to one another.

A mating axis 110 (shown in FIG. 9) extends through the receptacle and header assemblies 102, 104. The receptacle and header assemblies 102, 104 are mated together in a direction parallel to and along the mating axis 110. In an exemplary embodiment, both the circuit boards 106, 108 extend approximately parallel to the mating axis 110.

In an exemplary embodiment, the receptacle assembly 102 is modular in design and may include any number of components that are coupled together to create the receptacle assembly 102, depending on the particular application. The receptacle assembly 102 includes a shield body 118 providing selective shielding around and within the shield body 118. The receptacle assembly 102 includes a plurality of holders 120 that support a plurality of contact modules 122 (shown in FIG. 2). The holders 120 define the shield body 118. The contact modules 122 each include a plurality of receptacle contacts 124. In the illustrated embodiment, the receptacle contacts 124 constitute socket contacts, however other types of contacts may be utilized in alternative embodiments, such as pin contacts, spring beams, tuning-fork type contacts, blade type contacts, and the like. Any number of holders 120 may be provided. The holders 120 facilitate providing the modular design. For example, adding more holders 120 increases the number of contact modules 122 and thus the number of receptacle contacts 124. Alternatively, providing fewer holders 120 reduces the number of contact modules 122, and thus the number of receptacle contacts 124.

The receptacle assembly 102 includes a mating housing 126 at a mating end 128 of the receptacle assembly 102. The receptacle contacts 124 are received in the mating housing 126 and held therein for mating to the header assembly 104. The receptacle contacts 124 are arranged in a matrix of rows and columns. Any number of receptacle contacts 124 may be provided in the rows and columns. Optionally, the receptacle contacts 124 may be signal contacts arranged as differential pairs 129. The receptacle contacts 124 within each differential pair 129 are arranged within a common row and are part of different contact modules 122 and held in different holders 120. Optionally, the receptacle contacts 124 within each differential pair 129 may have the same length, and thus have a skewless design.

The receptacle assembly 102 includes a mounting, end 130 that is mounted to the circuit board 106. Optionally, the mounting end 130 may be substantially perpendicular to the mating end 128. The shield body 118 is arranged along the mounting end 130 for electrically grounding to the circuit board 106.

The receptacle assembly 102 includes end holders 132, 134 at opposite ends of the receptacle assembly 102. The end holders 132, 134 differ from the intermediate holders 120 provided between the end holders 132, 134, as will be described in further detail below. The end holders 132, 134 also define a portion of the shield body 118. The end holders 132, 134 hold contact modules 122 therein.

In an exemplary embodiment, the header assembly 104 is modular in design and may include any number of components that are coupled together to create the header assembly 104, depending on the particular application. The header assembly 104 includes a shield body 138 providing selective shielding around and within the shield body 138. The header assembly 104 includes a plurality of holders 140 that support a plurality of contact modules 142 (shown in FIG. 10). The holders 140 define the shield body 138. The contact modules 142 each include a plurality of header contacts 144. In the illustrated embodiment, the header contacts 144 constitute pin contacts, however other types of contacts may be utilized in alternative embodiments, such as socket contacts, spring beams, tuning-fork type contacts, blade type contacts, and the like. Any number of holders 140 may be provided. The holders 140 facilitate providing the modular design. For example, adding more holders 140 increases the number of contact modules 142 and thus the number of header contacts 144. Alternatively, providing fewer holders 140 reduces the number of contact modules 142, and thus the number of header contacts 144.

The header assembly 104 includes a plurality of mating housings 146 at a mating end 148 of the header assembly 104. The header contacts 144 are received in corresponding mating housings 146 and held therein for mating to the receptacle contacts 124 of the receptacle assembly 102. The header contacts 144 are arranged in a matrix of rows and columns that corresponds to the pattern of receptacle contacts 124. Any number of header contacts 144 may be provided in the rows and columns. Optionally, the header contacts 144 may be signal contacts arranged as differential pairs 149. The header contacts 144 within each differential pair 149 are arranged within a common row and are part of different contact modules 142 and held in different holders 140. Optionally, the header contacts 144 within each differential pair 149 may have the same length, and thus have a skewless design.

The header assembly 104 includes a mounting end 150 that is mounted to the circuit board 108. Optionally, the mounting end 150 may be substantially perpendicular to the mating end 148. The shield body 138 is arranged along the mounting end 150 for electrically grounding to the circuit board 108.

In an exemplary embodiment, the header assembly 104 includes end holders 152, 154 at opposite ends of the header assembly 104. The end holders 152, 154 differ from the intermediate holders 140 provided between the end holders 152, 154, as will be described in further detail below. The end holders 152, 154 also define a portion of the shield body 138. The end holders 152, 154 hold contact modules 142 therein. When assembled, the holders 140 and end holders 152, 154 cooperate to define a loading chamber 156 at the mating end 148. The loading chamber 156 is configured to receive a portion of the receptacle assembly 102, such as the mating housing 126. The receptacle assembly 102 is loaded into the loading chamber 156 along the mating axis 110 (shown in FIG. 9). The receptacle contacts 124 are mated to the header contacts 144 in the loading chamber 156. In an exemplary embodiment, the connector system 100 may be reversible, wherein the receptacle assembly 102 may be received in the header assembly 104 in two different orientations (e.g. 180° from each other). The size, shape and/or orientation of the mating interfaces are such that the receptacle assembly 102 may he loaded into the loading chamber 156 right side up or upside down.

Figure 2:
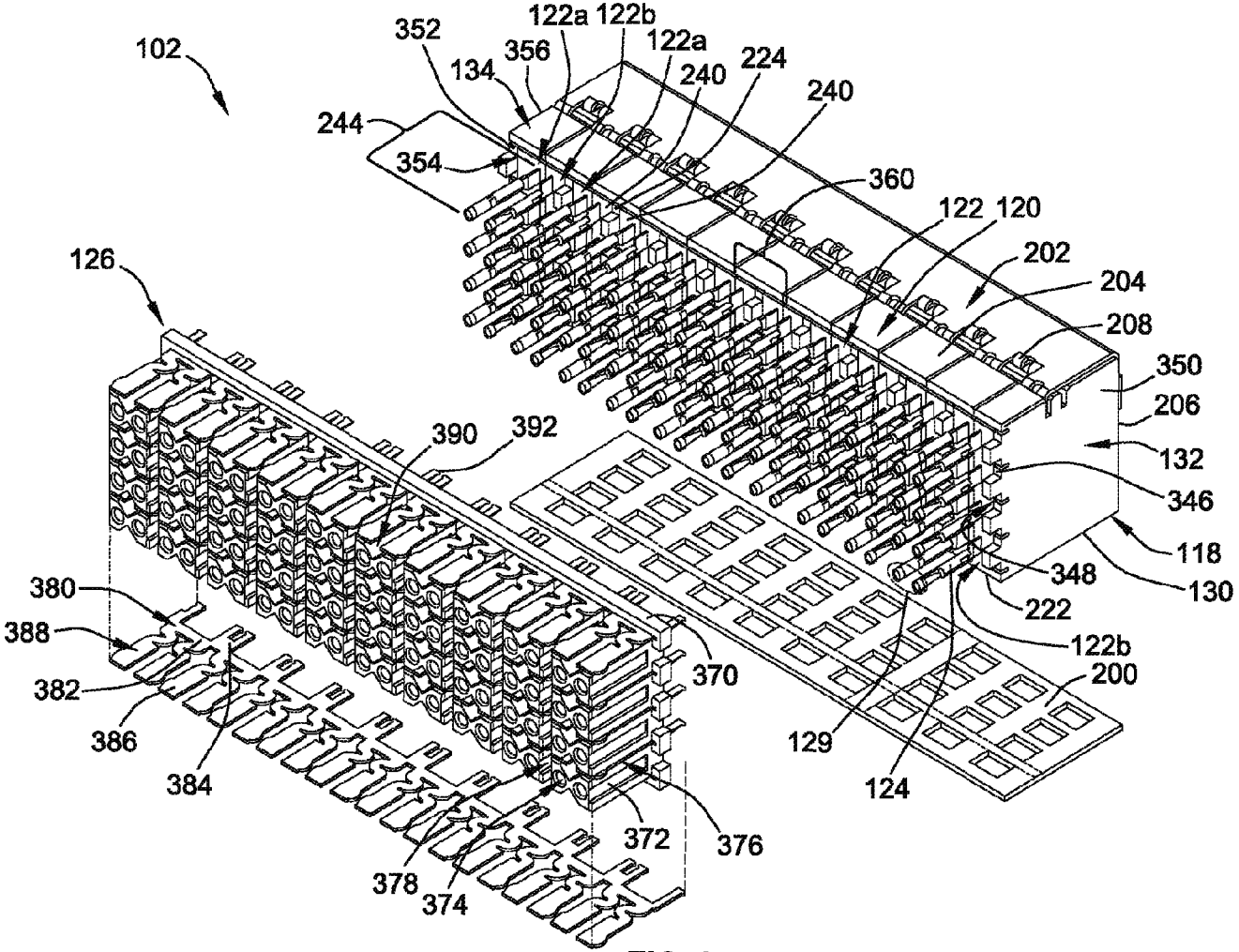
FIG. 2 is an exploded view of the receptacle assembly shown in FIG. 1.

FIG. 2 is an exploded view of the receptacle assembly 102. FIG. 2 illustrates the contact modules 122 loaded into corresponding holders 120. The mating housing 126 is poised for mounting to the holders 120. FIG. 2 also illustrates a conductive gasket 200 configured to be coupled to the mounting end 130 of the receptacle assembly 102. The conductive gasket 200 may be similar to the conductive gasket described in concurrently filed U.S. Patent Application titled GROUND INTERFACE FOR A CONNECTOR SYSTEM, Ser. No. 12/790,042, the complete subject matter of which is herein incorporated by reference in its entirety.

The conductive gasket 200 defines a ground path between the shield body 118 of the receptacle assembly 102 and the circuit board 106 (shown in FIG. 1). For example, the conductive gasket 200 may engage, and be electrically connected to the holders 120 to electrically common the holders 120 to a ground circuit on the circuit board 106.

The receptacle assembly 102 includes a retainer 202 coupled to each of the holders 120 and end holders 132, 134. The retainer 202 secures together each of the holders 120 and end holders 132, 134. Optionally, the holders 120 and end holders 132, 134 may be coupled directly to one another, such as using alignment or securing features integrated into the holders 120 and end holders 132, 134. Once held together, the holders 120 and end holders 132, 134 form the shield body 118 which structurally supports the contact modules 122 and electrically shields the contact modules 122.

In an exemplary, the retainer 202 extends along a top 204 and a rear 206 of the holders 120 and end holders 132, 134. The retainer 202 includes a plurality of fingers 208 that engage the corresponding holders 120 and end holders 132, 134. The fingers 208 secure the relative positions of the holders 120 and end holders 132, 134. Optionally, the holders 120 and end holders 132, 134 may be held in abutting contact to one another by the retainer 202. Alternatively, the holders 120 and end holders 132, 134 may be slightly spaced apart from one another and held in place by the retainer 202. As such, the retainer 202 may accommodate for manufacturing tolerances of the holders 120 and end holders 132, 134.

Figure 3:
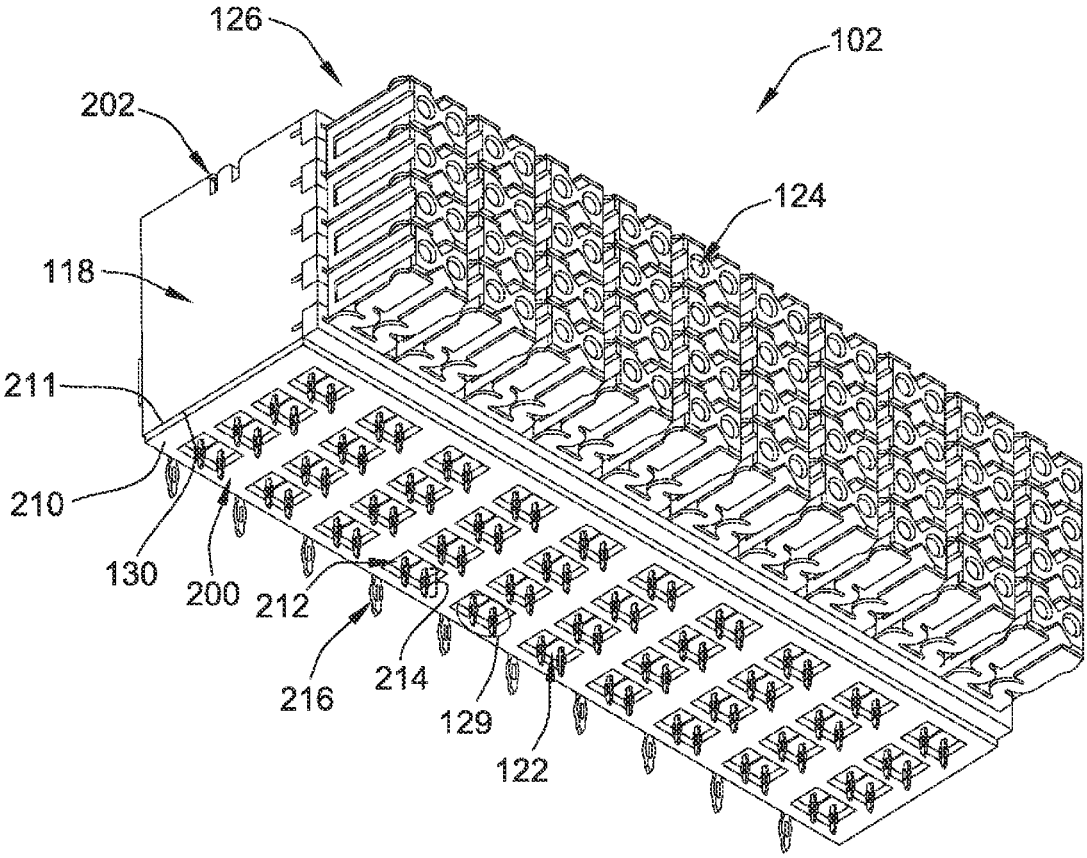
FIG. 3 is a bottom perspective view of the receptacle assembly.

FIG. 3 is a bottom perspective view of the receptacle assembly 102 in an assembled state. When assembled, the mating housing 126 is coupled to a front of the holders 120 (shown in FIG. 2). Additionally, the conductive gasket 200 is coupled to the mounting end 130.

The conductive gasket 200 includes a first mounting surface 210 that is configured to he mounted to, and engage, the circuit board 106. The conductive gasket 200 includes a second mounting surface 211 opposite the first mounting surface 210 that engages the shield body 118. The conductive gasket 200 includes a plurality of openings 212. Contact tails 214 of the receptacle contacts 124 extend from the contact modules 122 through respective openings 212. The contact tails 214 are configured to be received in conductive vias (not shown) of the circuit board 106 to make electrical connection to corresponding signal traces of the circuit board 106. In an exemplary embodiment, a pair of contacts tails 214 is provided within each opening 212. The pairs of contact tails 214 correspond to differential pairs 129 of the receptacle contact 124. As such, each differential pair 129 is surrounded by the conductive gasket 200 at the interface with the circuit board 106.

The conductive gasket 200 defines a ground path between the circuit board 106 and the shield body 118 of the receptacle assembly 102. As such, the shield body 118 is electrically grounded through the conductive gasket 200. The conductive gasket 200 allows the receptacle assembly 102 to be electrically grounded to the circuit board 106 without using individual ground contacts or ground pins that are received in corresponding vias of the circuit board 106. As such, the total number of pins that are terminated to the circuit board 106 is reduced by limiting the pins to signal contacts as opposed to signal and ground contacts. Additionally, positioning of ground vias in the circuit board 106 may be strategically placed as the ground vias do not need to be positioned for mating with corresponding ground pins extending from the receptacle assembly 102 (e.g. because the receptacle assembly 102 does not include ground pins). However, in alternative embodiments, the receptacle assembly 102 may be utilized without the conductive gasket 200, such as by including ground pins that are received in corresponding ground vias on the circuit board 106.

In an exemplary embodiment, the retainer 202 includes a plurality of retainer pins 216 extending below the mounting end 130 of the receptacle assembly 102. The retainer pins 216 are configured to be received in ground vias of the circuit board 106. As such, the retainer pins 216 are electrically connected to a ground circuit of the circuit board 106. The retainer 202 is thus grounded and electrically commoned with the circuit board 106. Alternatively, the retainer 202 may be connected to the circuit board 106 via the conductive gasket 200. The reception of the retainer pins 216 in the circuit board 106 helps hold the receptacle assembly 102 onto the circuit board 106. Any number of retainer pins 216 may be provided depending on the particular embodiment.

Figure 4:
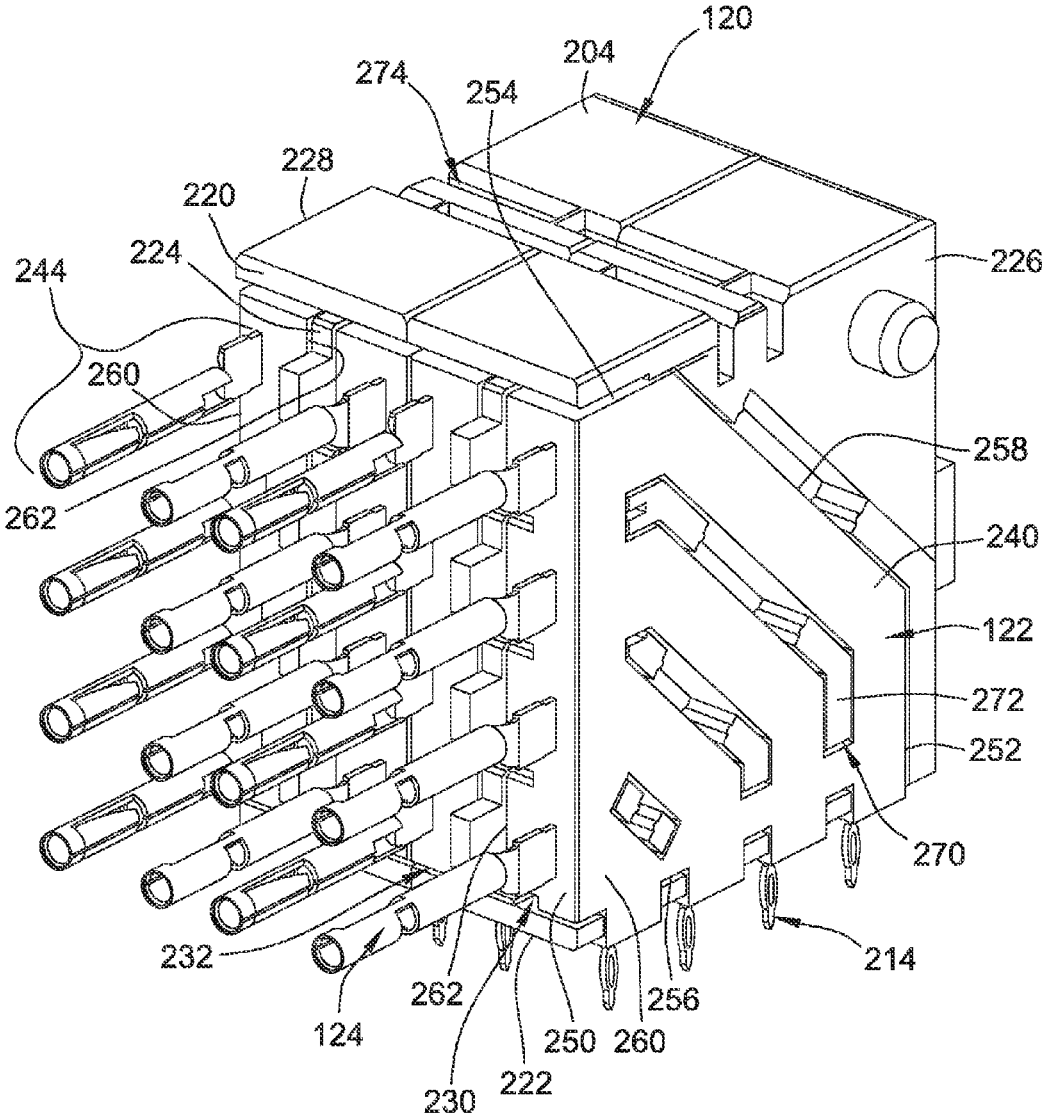
FIG. 4 is a front perspective view of a portion of the receptacle assembly showing a plurality of contact modules and plurality of holders.

FIG. 4 is a front perspective view of a portion of the receptacle assembly 102 showing a plurality of contact modules 122 and a plurality of holders 120. The holders 120 include a front 220 and a bottom 222 opposite the top 204. The holder 120 includes a body configured to support a plurality of the contact modules 122. The body defines a portion of the shield body 118 (shown in FIG. 1). In the illustrated embodiment, each holder 120 supports two contact modules 122. More or less contact modules 122 may be supported by a particular holder 120 in alternative embodiments. In an exemplary embodiment, the holder 120 is fabricated from a conductive material. For example, the holder 120 may be die-cast from a metal material. Alternatively, the holder 120 may be stamped and formed or may be fabricated from a plastic material that has been metalized or coated with a metallic layer. By having the holder 120 fabricated from a conductive material, the holder 120 may define a ground shield for the receptacle assembly 102. A separate ground shield does not need to be provided and coupled to the contact modules 122 prior to assembling together the contact modules 122. Rather, the holders 120 define the ground shield and also support the contact modules 122 as part of the shield body 118. When the holders 120 are ganged together, the holders 120 define the shield body 118 of the receptacle assembly 102. The holders 120 may be ganged together by coupling the individual holders 120 to one another or by using a separate component, such as the retainer 202 (shown in FIG. 2). The holders 120 are ganged together such that the contact modules 122 are stacked parallel to one another. Portions of the holders 120 may extend between respective contact modules 122 to provide electrical shielding therebetween.

The holders 120 provide electrical shielding between and around respective contact modules 122. The holders 120 provide shielding from electromagnetic interference (EMI) and/or radio frequency interference (RFI). The holders 120 may provide shielding from other types interference as well. The holders 120 provide shielding around the contact modules 122 to control electrical characteristics, such as impedance control, cross-talk control, and the like, of the receptacle contacts 124 within the contact modules 122. For example, by having the holders 120 electrically grounded, the holders 120 provide shielding for the contact modules 122 to control the electrical characteristics. In the illustrated embodiment, the holders 120 provide shielding along the top, back, and bottom of the contact modules 122. Optionally, the holders 120 may provide shielding between any or all of the contact modules 122. For example, as in the illustrated embodiment, each holder 120 includes a support wall 224. The support wall 224 is provided between the pair of contact modules 122 held by the holder 120. The support wall 224 provides shielding between the contact modules 122 held by the holder 120. Optionally, the support wall 224 may be substantially centrally located between opposite sides 226, 228 of the holder 120. The holder 120 includes a first receptacle chamber 230 at the first side 226 and a second receptacle chamber 232 at the second side 228. Each receptacle chamber 230, 232 receives one of the contact modules 122 therein. The contact modules 122 are loaded into the corresponding receptacle chambers 230, 232 such that the contact modules 122 abut against the support wall 224. Alternatively, the receptacle chambers 230 and/or 232 may receive more than one contact module 122. In other alternative embodiments, only one receptacle chamber is provided in each holder 120, with the receptacle chamber receiving one, two or more contact modules 122 therein.

Each contact module 122 includes a dielectric body 240 surrounding the receptacle contacts 124. In an exemplary embodiment, the receptacle contacts 124 are initially held together as a lead frame 242 (shown in FIG. 5), which is overmolded with a dielectric material to form the dielectric body 240. After the lead frame 242 is overmolded, the receptacle contacts 124 are separated from one another. Other manufacturing processes may be utilized to form the contact modules 122 other than overmolding a lead frame, such as loading receptacle contacts 124 into a formed dielectric body.

Each of the receptacle contacts 124 includes one of the contact tails 214 at one end thereof, and a mating portion 244 at an opposite end thereof. The mating portions 244 and contact tails 214 are the portions of the receptacle contacts 124 that extend from the dielectric body 240. In an exemplary embodiment, the mating portions 244 extend generally perpendicular with respect to the contact tails 214. The receptacle contacts 124 transition between the mating portions 244 and the contact tails 214 within the dielectric body 240. Alternatively, the mating portions 244 may be non-perpendicular with respect to the contact tails 214. For example, the mating portions 244 may be parallel to the contact tails 214. Optionally, the mating portions 244 may be axially aligned with the contact tails 214.

The dielectric body 240 includes a front wall 250, a rear wall 252 generally opposite the front wall 250, a top wall 254 and a bottom wall 256 generally opposite the top wall 254. Optionally, the dielectric body 240 may include a slant wall 258 extending between the top wall 254 and the rear wall 252. The slant wall 258 is angled with respect to the top wall 254 and the rear wall 252. In an exemplary embodiment, the front and rear walls 250, 252 are parallel to one another and the top and bottom walls 254, 256 are parallel to one another and generally perpendicular with the respect to the front and rear walls 250, 252. The mating portions 244 of the receptacle contacts 124 extend from the front wall 250 of the dielectric body 240. The contact tails 214 of the receptacle contacts 124 extend from the bottom wall 256 of the dielectric body 240. Other configurations are possible in alternative embodiments.

The dielectric body 240 includes a first side 260 and a second side 262 generally opposite the first side 260. The first and second sides 260, 262 are generally parallel to the sides 226, 228 of the holder 120. The first side 260 represents an outer side of the dielectric body 240 that is exposed exterior of the holder 120. The second side 262 represents an inner side of the dielectric body 240 that is loaded into the corresponding receptacle chamber 230 against the support wall 224.

The dielectric body 240 includes a plurality of windows 270 extending through the dielectric body 240 between the first and second sides 260, 262. The windows 270 are open between the first and second sides 260, 262 and are spaced apart from an outer perimeter of the dielectric body 240, which is defined by the front wall 250, rear wall 252, top wall 254, bottom wall 256 and slant wall 258. The windows 270 are internal of the dielectric body 240 and located between adjacent receptacle contacts 124. For example, one or more windows 270 may be positioned between adjacent receptacle contacts 124. The windows 270 extend along lengths of the receptacle contacts 124 between the contact tails 214 and the mating portions 244. Optionally, the windows 270 may extend along a majority of the length of each receptacle contact 124 measured between the corresponding contact tail 214 and mating portion 244. The windows 270 are elongated and generally follow the paths of the receptacle contacts 124 between the contact tails 214 and the mating portions 244. The windows 270 are formed during the overmolding process that forms the dielectric body 240. For example, the dielectric body 240 is formed around molding elements that have a predetermined size and shape. The molding elements define the size, shape and position of the windows 270. In an exemplary embodiment, as described in further detail below, the holders 120 include tabs 272, 300 (shown in FIG. 7) that extend into the windows 270 when the contact modules 122 are coupled to the holders 120. The tabs 272, 300 support the contact modules 122 within the corresponding receptacle chambers 230, 232. The tabs 272, 300 provide shielding between the adjacent receptacle contacts 124.

The holders 120 include slots 274 formed in the tops 204 of the holders 120. The slots 274 are configured to receive the fingers 208 of the retainer 202 (both shown in FIG. 2). In an exemplary embodiment, the slots 274 are open along the sides 226, 228 of the holder 120 such that when two holders 120 are placed adjacent to one another, the slots 274 are open to one another. The fingers 208 are received in the slots 274 of adjacent holders 120 such that the fingers 208 span across the interface between the holders 120. The relative positions of the adjacent holders 120 can be maintained by the retainer 202. Different configurations of fingers 208 are possible in alternative embodiments (e.g. fingers 208 that do not span across interfaces between holders 120). In other alternative embodiments, other types of securing features may be used to secure the holders 120 together (e.g. protrusions on the holders 120 that extend into slots of the retainer or other types of latches or securing features).

Figure 5:
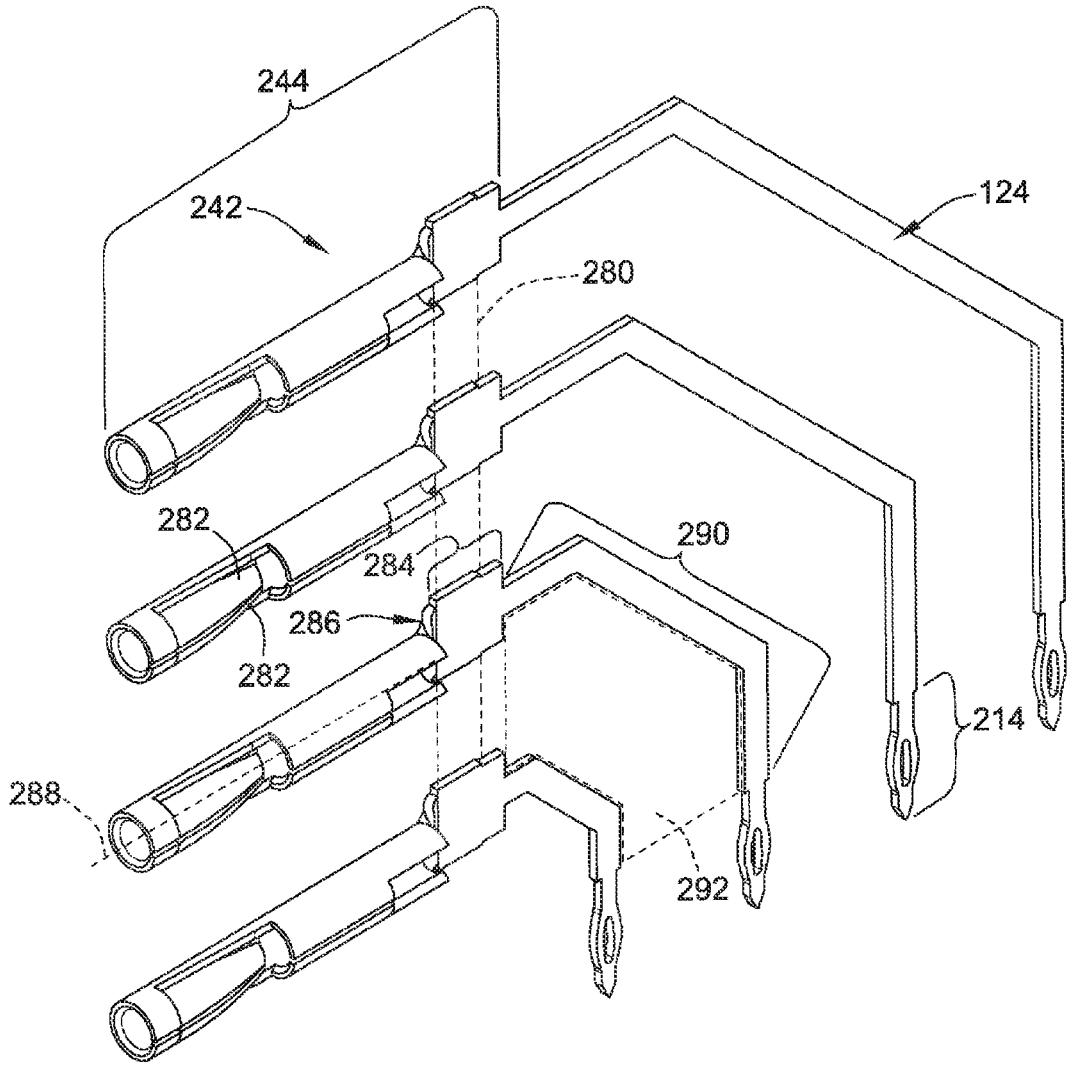
FIG. 5 is a front perspective view of a lead frame for one of the contact modules.

FIG. 5 is a front perspective view of the lead frame 242 for one of the contact modules 122 (shown in FIG. 4). The lead frame 242 includes a plurality of the receptacle contacts 124. The receptacle contacts 124 are manufactured by stamping and forming the receptacle contacts 124 from a stock piece of metal material. Each of the receptacle contacts 124 is manufactured from the same piece of material. During manufacturing, the receptacle contacts 124 are initially held together by a carrier 280 (shown in phantom in FIG. 5). The carrier 280 maintains the relative positions of the receptacle contacts 124 during the overmolding process that forms the dielectric body 240 (shown in FIG. 4). After the lead frame 242 is overmolded, the carrier 280 is removed, thus separating the receptacle contacts 124 from one another. The receptacle contacts 124 may be manufactured from a different process other than stamping and forming, such as die-casting, in alternative embodiments.

Each of the receptacle contacts 124 includes one of the contact tails 214 and one of the mating portions 244. In the illustrated embodiment, the contact tails 214 constitute press-fit pins that are configured to be received in plated vias of the circuit board 106 (shown in FIG. 1). The mating portions 244 constitute socket contacts having a generally barrel shape that is configured to receive the header contacts 144 (shown in FIG. 1). The mating portions 244 may be formed by rolling the ends of the receptacle contacts 124 into a barrel shape.

In an exemplary embodiment, the mating portions 244 include spring arms 282 that are positioned within the barrel of the mating portions 244. The spring arms 282 are configured to be deflected outward when the header contacts 144 are loaded into the mating portions 244. When deflected outward, the spring arms 282 are biased against the header contacts 144 to ensure electrical and mechanical engagement between the receptacle contacts 124 and header contacts 144.

In an exemplary embodiment, the barrel of the mating portions 244 extend beyond the spring arms 282. The mating portions 244 are configured to receive the header contacts 144 such that the tips of the header contacts 144 are positioned beyond the spring arms 282. Because the mating portions 244 are barrel shaped, the mating portions 244 extend substantially entirely circumferentially around the header contacts 144 even beyond the points of contact with the header contacts 144 by the spring arms 282. As such, no electrical stub is created at the interface between the receptacle contacts 124 and the header contacts 144 because the header contacts 144 remain entirely within the receptacle contacts 124.

The mating portions 244 each include a carrier plate 284 and a transition portion 286 between the barrel portion and the carrier plate 284. The transition portion 286 transitions the receptacle contact 124 from a generally planar structure to a barrel shaped structure. The transition portion 286 may also position the barrel portion such that a central axis 288 of the barrel portion is offset with respect to a contact plane of the remainder of the receptacle contact 124. As such, the position of the barrel portion with respect to the front wall 250 (shown in FIG. 4) of the dielectric body 240 (shown in FIG. 4) may be controlled to move the central axis 288 towards either the first side 260 or the second side 262 (both shown in FIG. 4) of the dielectric body 240.

The receptacle contacts 124 include transition sections 290 between the contact tails 214 and mating portions 244. The transition sections 290 have lengths measured between the contact tails 214 and mating portions 244. The lengths of the receptacle contacts 124 are different than one another, with the inner receptacle contact 124 (closest to the bottom) being the shortest and the outer receptacle contact 124 (closest to the top) being the longest The transition sections 290 are generally the portions of the receptacle contacts 124 that are encased within the dielectric body 240. A transition area 292 is defined between the transition sections 290 of adjacent receptacle contacts 124. The windows 270 (shown in FIG. 4) are aligned with the transition areas 292 when the contact module 122 is formed. The windows 270 are spaced apart from, and positioned between, adjacent receptacle contacts 124. As noted above, the windows 270 receive the tabs 272 (shown in FIG. 4), which provide electrical shielding between adjacent transition sections 290. The tabs 272 may extend a majority of the lengths of the receptacle contacts 124 to provide electrical shielding between such receptacle contacts 124. In an exemplary embodiment, each adjacent receptacle contact 124 forms part of a different differential pair 129 (shown in FIG. 2), and the tabs 272 thus provide electrical shielding between adjacent differential pairs 129.

Figure 6:
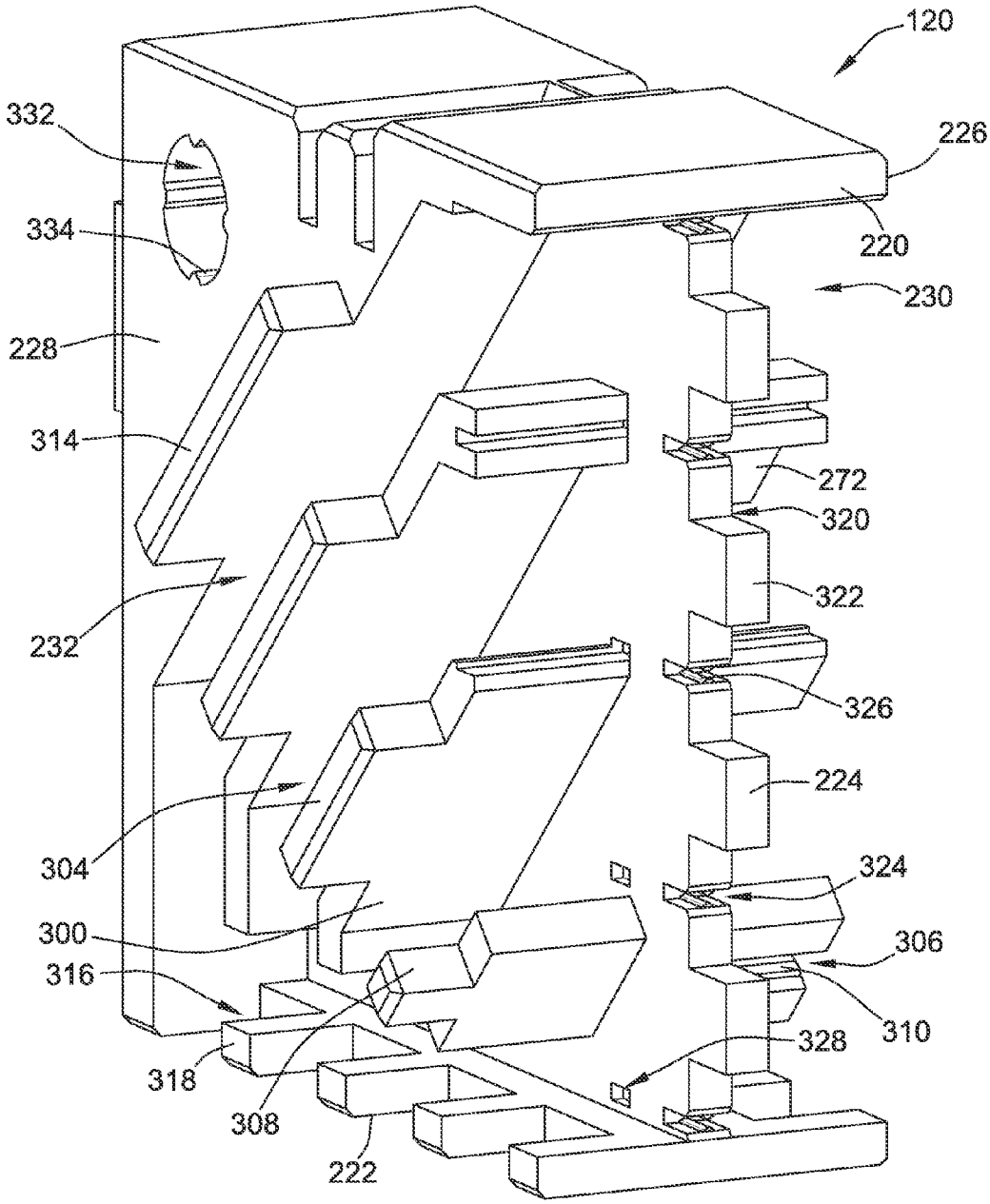
FIG. 6 is a front perspective view of a first side of one of the holders.
Figure 7:
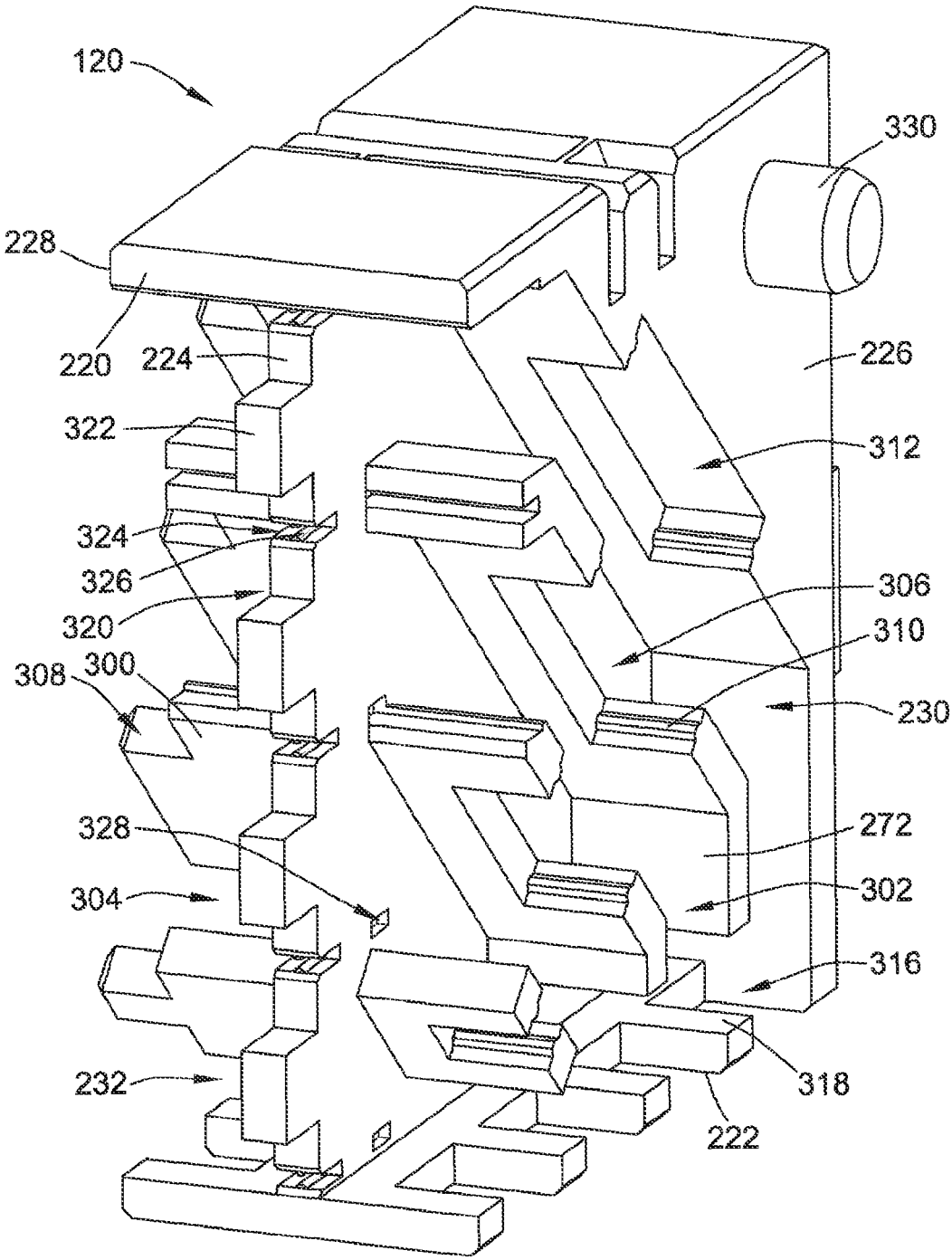
FIG. 7 is a front perspective view of another side of one of the holders.

FIG. 6 is a front perspective view of the first side 260 of one of the holders 120. FIG. 7 is a front perspective view of the second side 262 of one of the holders 120. The support wall 224 is generally centrally located between the first and second sides 226, 228. The support wall 224 is substantially planar and defines an inner surface of the first and second receptacle chambers 230, 232.

The tabs 272 extend outward from the support wall 224 into the first receptacle chamber 230. The tabs 300 extend outward from the support wall 224 into the second receptacle chamber 232. As described above, the tabs 272, 300 are configured to be received in windows 270 (shown in FIG. 4). In the illustrated embodiment, the tabs 272, 300 define ledges that support the contact modules 122 (shown in FIG. 4) when the contact modules 122 are loaded into the receptacle chambers 230, 232. In an exemplary embodiment, the tabs 272, 300 are integrally formed with the support wall 224 and the other portions of the holders 120. The tabs 272, 300 thus form part of the shield body 118 (shown in FIG. 1). Optionally, the holders 120 may be die-cast to form the support wall 224 and the tabs 272, 300. The tabs 272 extend into the receptacle chamber 230 such that channels 302 are formed on both sides of each tab 272. Optionally, the channels 302 may open to one another at ends of the tabs 272. Similarly, the tabs 300 extend into the receptacle chamber 232 such that channels 304 are defined on both sides of the tabs 300. The channels 302, 304 receive respective dielectric bodies 240 (shown in FIG. 4) therein.

In an exemplary embodiment, the tabs 272, 300 are configured to be interdigitated when the holders 120 are ganged together. For example, the tabs 272 each have slots 306 formed therein. The tabs 300 each include projections 308 configured to be received within corresponding slots 306 of an adjacent holder 120. When the projections 308 are received in the slots 306 of the adjacent holders 120, the projections 308 are at least partially received in the windows 270 of the contact module 122 held by the adjacent holder 120. Optionally, as in the illustrated embodiment, the tabs 272 may include a bulge 310 along one or more of the walls forming the slots 306. The bulges 310 engage the projections 308 when the holders 120 are coupled together. Alternatively, the projections 308 may include bulges along side walls thereof that engage the walls of the slots 306 when the holders 120 are mated together. In an alternative embodiment, rather than being interdigitated, the tabs 272, 300 may have flat distal ends that abut against corresponding tabs 300, 272, respectively, of adjacent holders 120.

In an exemplary embodiment, on the first side 226, the holder 120 includes a slot 312 (shown in FIG. 6) outward of the outermost channel 302. The holder 120, on the second side 228, includes a projection 314 (shown in FIG. 7) outward of the outermost channel 304. The projection 314 is configured to be received within the slot 312 of an adjacent holder 120 when the holders 120 are stacked together. Having the projection 314 received in the slot 312, as well as the projections 308 received in the slots 306, allows the adjacent holders 120 to be electrically commoned proximate to the contact modules 122. Additionally, having multiple points of contacts between the holders 120 allows the holders 120 to be electrically commoned at more than one location along the holders 120.

The bottom 222 of the holder 120 includes a plurality of openings 316. Fingers 318 are provided between each of the openings 316. Portions of the contact modules 122 are received in the openings 316 when the contact modules 122 are loaded into the first and second receptacle chambers 230, 232. The fingers 318 are positioned between such portions of the contact modules 122 to provide electrical shielding between such portions of the contact modules 122. The bottom 222 of the holder 120 also provides a surface for interfacing with the conductive gasket 200 (shown in FIG. 2).

The front 220 includes a plurality of openings 320 separated by fingers 318. A portion of the mating housing 126 (shown in FIG. 2) is received in the openings 316 when the receptacle assembly 102 (shown in FIG. 2) is assembled. In an exemplary embodiment, slots 324 extend into the support wall 224 from the openings 316. Optionally, the slots 324 may have bulges 326 extending into the slots 324. In an exemplary embodiment, the support wall 224 includes openings 328 aligned with, and spaced apart rearward of, the slots 324. The openings 328 are provided for connection and retention of the mating housing 126, as will be described in further detail below.

The holder 120 includes alignment features 330, 332 on the first and second sides 260, 262, respectively. In the illustrated embodiment, the alignment feature 330 is represented by a post and the alignment feature 332 is represented by an opening 328. The alignment feature 330 is configured to be received within the alignment feature 332 of an adjacent holder 120. Optionally, the alignment feature 330 may be securely held within the alignment feature 332 of the adjacent holder 120 by an interference fit. For example, the alignment feature 332 may include bulges 334 that extend into the opening 328. Other types of alignment features are possible in alternative embodiments. Additionally, more than one alignment feature 330 may be provided on the first side 226 and more than one alignment feature 332 may be provided on the second side 228.

Figure 8:
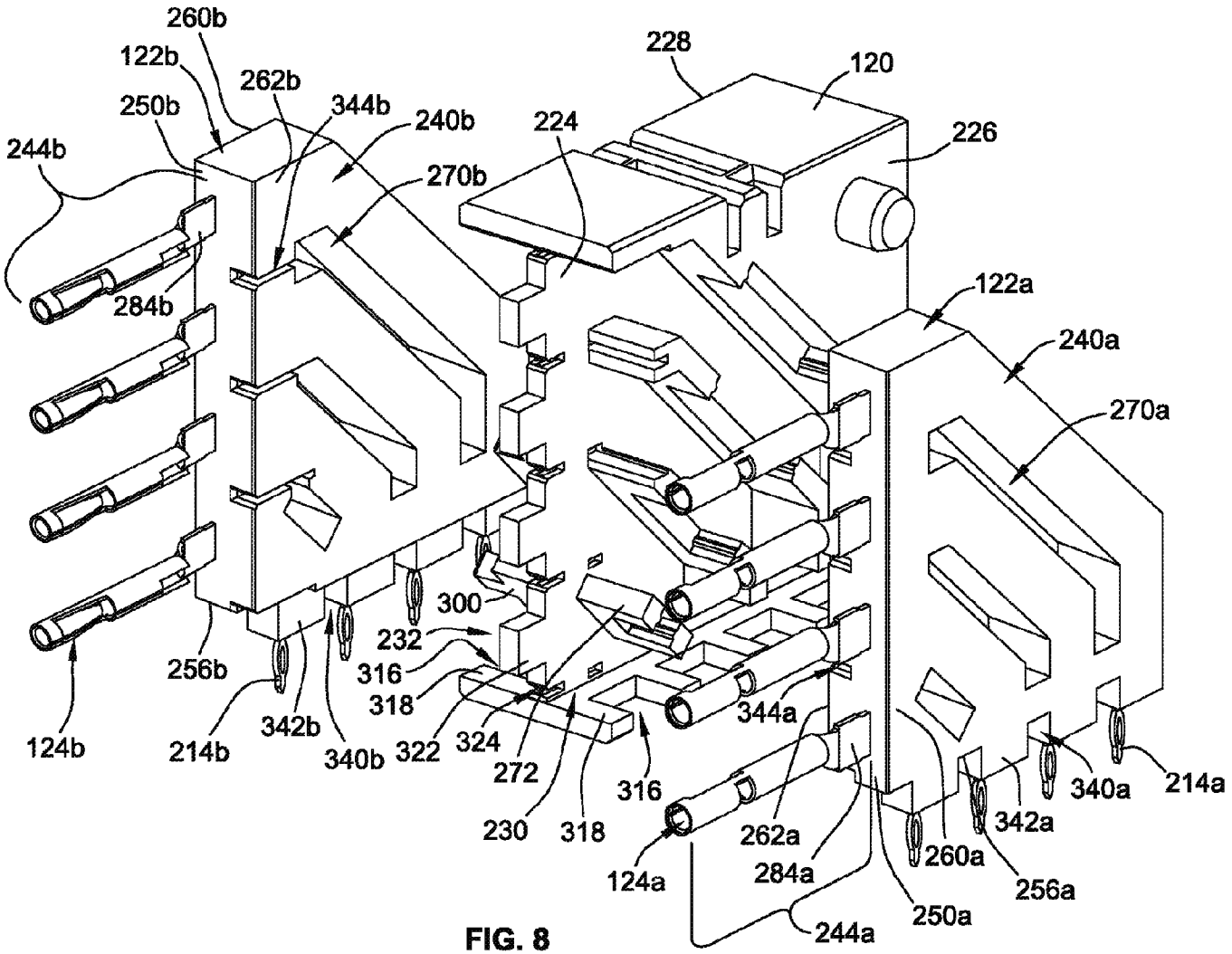
FIG. 8 is an exploded view of one of the holders and corresponding contact modules.

FIG. 8 is a front perspective view of one of the holders 120 and corresponding contact modules 122*a* and 122*b* poised for coupling to the holder 120. The contact modules 122*a*, 122*b* are substantially similar to one another, and include similar components. The components of the contact module 122*a* will be designated with an "a" designation. The components of the contact module 122*b* will be designated with a "b" designation. The contact module 122*a* is configured to be received in the first receptacle chamber 230. The contact module 122*b* is configured to be received in the second receptacle chamber 232. While the contact modules 122*a*, 122*b* are illustrated as being mirrored images of one another, it is realized that the contact modules 122*a*, 122*b* may be different from one another and include different features. For example, the transition portions 286*a* and 286*b* may transition the mating portions 244*a* and 244*b*, respectively, in different directions.

During assembly, the contact module 122*a* is loaded into the first receptacle chamber 230 such that the tabs 272 are received in the windows 270*a*. The windows 270*a* are provided in the transition areas 292 between corresponding transition sections 290 (both shown in FIG. 5). As such, the windows 270*a* extend along, and are provided between, adjacent receptacle contacts 124*a* within the dielectric body 240*a*. The tabs 272 provide electrical shielding between adjacent contacts 124*a*. The tabs 272 provide electrical shielding along the entire length of the respective window 270*a*. Depending on the size and length of the window 270*a* and corresponding tab 272, the contacts 124*a* may be electrically shielded along a majority of the length of the transition sections 290.

The bottom wall 256*a* of the contact module 122*a* includes a plurality of openings 340*a* that separate leg portions 342*a* of the dielectric body 240*a* at the bottom wall 256*a*. The receptacle contacts 124*a* extend through the leg portion 342*a* and the contact tails 214*a* extend outward from respective leg portions 342*a*. When the contact module 122*a* is loaded into the receptacle chamber 230, the leg portions 342*a* are received in the openings 316. The fingers 318 are received in the openings 340*a* and are thus provided between the portions of the receptacle contacts 124*a* extending through the leg portions 342*a*. The fingers 318 provide shielding between such portions of the receptacle contacts 124*a*.

The mating portions 244*a* extend from the front wall 250*a*. In the illustrated embodiment, the carrier plates 284*a* are exposed beyond the front wall 250*a*. As described above, after the dielectric body 240*a* is formed, the carrier 280 (shown in FIG. 5) is removed between the carrier plates 284*a*. The front wall 250*a* includes a plurality of slots 344*a* extending inward from the second side 262*a*. Optionally, the slots 344*a* may extend only partially between the second side 262*a* and the first side 260*a*. Alternatively, the slots 344*a* may extend entirely between the second side 262*a* and the first side 260*a*. When the contact module 122*a* is loaded into the first receptacle chamber 230, the slots 344*a* are aligned with the slots 324 in the support wall 224. When the contact module 122*a* is loaded into the first receptacle chamber 230, the carrier plates 284*a* are aligned with respective fingers 322 extending from the support wall 224. The fingers 322 provide shielding between the carrier plates 384*a* of the contact module 122*a* and the carrier plates 384*b* of the contact module 122*b*.

During assembly, the contact module 122*b* is loaded into the second receptacle chamber 232 such that the tabs 300 are received in the windows 270*b*. The bottom wall 256*b* of the contact module 122*b* includes a plurality of openings 340*b* that separate leg portions 342*b* of the dielectric body 240*b* at the bottom wall 256*b*. The receptacle contacts 124*b* extend through the leg portion 342*b* and the contact tails 214*b* extend outward from respective leg portions 342*b*. When the contact module 122*b* is loaded into the receptacle chamber 230, the leg portions 342*b* are received in the openings 316 on the second side 228 of the holder 120. The fingers 318 on the second side 228 are received in the openings 340*b* and are thus provided between the portions of the receptacle contacts 124*b* extending through the leg portions 342*b*. The fingers 318 provide shielding between such portions of the receptacle contacts 124*b*.

The mating portions 244*b* extend from the front wall 250*b*. In the illustrated embodiment, the carrier plates 284*b* are exposed beyond the front wall 250*b*. The front wall 250*b* includes a plurality of slots 344*b* extending inward from the second side 262*b*. Optionally, the slots 344*b* may extend only partially between the second side 262*b* and the first side 260*b*. Alternatively, the slots 344*b* may extend entirely between the second side 262*b* and the first side 260*b*. When the contact module 122*b* is loaded into the second receptacle chamber 232, the slots 344*b* are aligned with the slots 324 in the support wall 224 and with the slots 344*a* in the contact module 122*a*. When the contact module 122*b* is loaded into the second receptacle chamber 232, the carrier plates 284*b* are aligned with respective fingers 322 extending from the support wall 224. The fingers 322 provide shielding between the carrier plates 384*a* of the contact module 122*a* and the carrier plates 384*b* of the contact module 122*b*.

Returning to FIG. 2, after each of the contact modules 122*a*, 122*b* is loaded into the corresponding holder 120, each of the holders 120 (any number of which may be provided depending on the particular application) is ganged together and coupled to one another. The end holders 132, 134 are then provided at the corresponding ends. The end holder 132 supports a contact module 122*b* and the end holder 134 supports a contact module 122*a*. The end holder 132 has a support wall 346 that may be similar to the support wall 224 of one of the holders 120, however the support wall 346 only includes tabs (not shown, but similar to the tabs 300) extending from one side of the support wall 346 and only defines a single receptacle chamber 348 that receives the corresponding contact module 122*b*. An outer surface 350 of the support wall 346 is generally planar and defines an outer surface of the receptacle assembly 102. The end holder 134 includes a support wall 352 that may be similar to the support wall 224 of one of the holders 120, however the support wall 352 only includes tabs (not shown, but similar to the tabs 272) extending from one side of the support wall 352 and only includes a single receptacle chamber 354 that receives the corresponding contact module 122*a*. The support wall 352 includes an outer surface 356 that is substantially planar and defines an outer surface of the receptacle assembly 102.

In an exemplary embodiment, the contact modules 122*a* and 122*b* are arranged in contact module sets 360. Each contact module set 360 includes a plurality of the differential pairs 129 of receptacle contacts 124. Each contact module set 360 includes one of the contact modules 122*a* and one of the contact modules 122*b*. One of the receptacle contacts 124*a* of each differential pair 129 is held by the contact module 122*a* and the other receptacle contact 124*b* is held by the contact module 122*b*. The contact modules 122*a*, 122*b* within a particular contact module set 360 are arranged within different holders 120 (or end holders 134, 132) that are adjacent to each other. The contact modules 122*a*, 122*b* within a particular holder 120 form parts of different contact module sets 360. The contact module sets 360 are separated from adjacent contact module sets 360 by the support walls 224. The support walls 224 provide electrical shielding between adjacent contact module sets 360. Additionally, the top 204, the rear 206, and the bottom 222 of the holders 120 surround and enclose the contact modules 122*a*, 122*b* of the contact module set 360. As such, each contact module set 360 is electrically shielded by the holders 120. In an exemplary embodiment, the holders 120 substantially circumferentially surround the differential pairs 129 of receptacle contacts 124 along a majority of the length of the receptacle contacts between the contact tails 214 and the mating portions 244. For example, the support walls 224 and the tabs 272, 300 provide electrical shielding around the receptacle contacts 124. Furthermore, the mating housing 126 provides electrical shielding for the mating portions 244 and the conductive gasket 200 and circuit board 106 (shown in FIG. 1) provide electrical shielding for the contact tails 214.

The dielectric bodies 240 of the contact modules 122*a*, 122*b*, in each contact module set 360, are surrounded by the holders 120 such that the dielectric bodies 240 are electrically shielded. The mating portions 244 extend from the dielectric body 240 and are received in the mating housing 126. The mating housing 126 is coupled to the holders 120 to provide electrical shielding for the mating portions 244.

The mating housing 126 includes a base 370 that is configured to be mounted to the front of the holders 120 and contact modules 122. The mating housing 126 includes a plurality of silos 372 extending forward from the base 370. The mating housing 126 includes a plurality of contact channels 374 extending through the silos 372 and the base 370. The contact channels 374 receive the mating portions 244 of the receptacle contacts 124 to provide support for the receptacle contacts 124. In an exemplary embodiment, each silo 372 includes two contact channels 374 that receive receptacle contacts 124 of one of the differential pairs 129 of receptacle contacts.

The silos 372 are separated from one another by a horizontal space 376 and a vertical space 378. The vertical spaces 378 are wider than the horizontal spaces 376. The vertical spaces 378 are configured to receive walls of the holder 140 (shown in FIG. 1) therein to provide shielding between columns of silos 372. In an exemplary embodiment, a plurality of ground clips 380 are coupled to the mating housing 126 between corresponding silos 372, and thus between corresponding contacts channels 374. In an exemplary embodiment, the ground clips 380 are received in the horizontal space 376 between the silos 372. The ground clips 380 are relatively thin, as compared to the thickness of the support wall 224, and thus allow the mating housing 126 to be shorter than if the mating housing 126 were to receive die cast walls horizontally between the silos 372. In an alternative embodiment, the ground clips 380 may additionally, or alternatively, be received in the vertical space 378 between adjacent silos 372.

The ground clips 380 include a base 382 with legs 384 extending from one side of the base 382 and spring arms 386 extending from the opposite side of the base 382. Optionally, as in the illustrated embodiment, the ground clips 380 may be elongated such that the ground clips 380 extend along each of the columns of silos 372. In other words, the ground clips 380 extend an entire width of the mating housing 126 and include spring arms 386 that are aligned above each of the silos 372 within a particular row of silos 372. Alternatively, individual ground clips 380 may be provided, with each ground clip 380 extending over a single silo 372. In other alternative embodiments, the ground clips 380 may be sized to extend along any number of silos 372.

When the ground clips 380 are coupled to the mating housing 126, the base 382 is generally aligned with the base 370 of the mating housing 126. The legs 384 extend rearward from the base 370. The spring arms 386 extend forward from the base 370 along the silos 372. Optionally, a separate spring arm 386 may be aligned with, and correspond to, a particular contact channel 374. Multiple ground clips 380 are coupled to the mating housing 126 such that each contact channel 374 is flanked both above and below the contact channel 374 by respective spring arms 386. The spring arms 386 are cantilevered from the base 382 such that the spring arms 386 may be deflected.

In an exemplary embodiment, each spring arm 386 includes a wing 388 extending outward therefrom. The wings 388 are configured to engage the header assembly 104 (shown in FIG. 1) when the receptacle assembly 102 is mated with the header assembly 104. When the wings 388 engage the header assembly 104, the spring arms 386 may be deflected inward, and the spring arms 386 may be biased against the header assembly 104 to ensure contact between the spring arms 386 and the header assembly 104. As such, electrical contact is made between the spring arms 386 and the header assembly 104, which electrically commons the receptacle assembly 102 and the header assembly 104. The spring arms 386 provide electrical shielding along the mating portions 244 of the receptacle contacts 124. The spring arms 386 provide shielding above and below the mating portions 244.

In an exemplary embodiment, the silos 372 include notches 390 formed in a top and a bottom of the silos 372. Notches may be formed in the sides of the silos 372 in addition to, or alternatively to, the top and bottom. The notches 390 may have a triangular shape, as in the illustrated embodiment, or may have other shapes, such as rectangular or hemispherical shapes, in alternative embodiments. The notches 390 provide an air space proximate to the contact channels 374, and thus the respective mating portions 244, which may affect the electrical characteristics of the receptacle contacts 124, such as by controlling an impedance of the receptacle contacts 124. The size and positioning of the notches 390 may be selected to achieve a particular impedance level.

The legs 384 extend rearward from the mating housing 126. When the mating housing 126 is coupled to the holders 120 and contact modules 122, the legs 384 extend into the slots 324 and the slots 344. The legs 384 engage the bulges 326 to ensure electrical contact between the holders 120 and the ground clips 380. As such, the ground clips 380 may be electrically commoned with the holders 120. The legs 384 include latches 392 at ends thereof that are configured to be received in the openings 328 (shown in FIGS. 6 and 7) in the support walls 224 to secure the ground clips 380 and the mating housing 126 to the holders 120.

Figure 9:
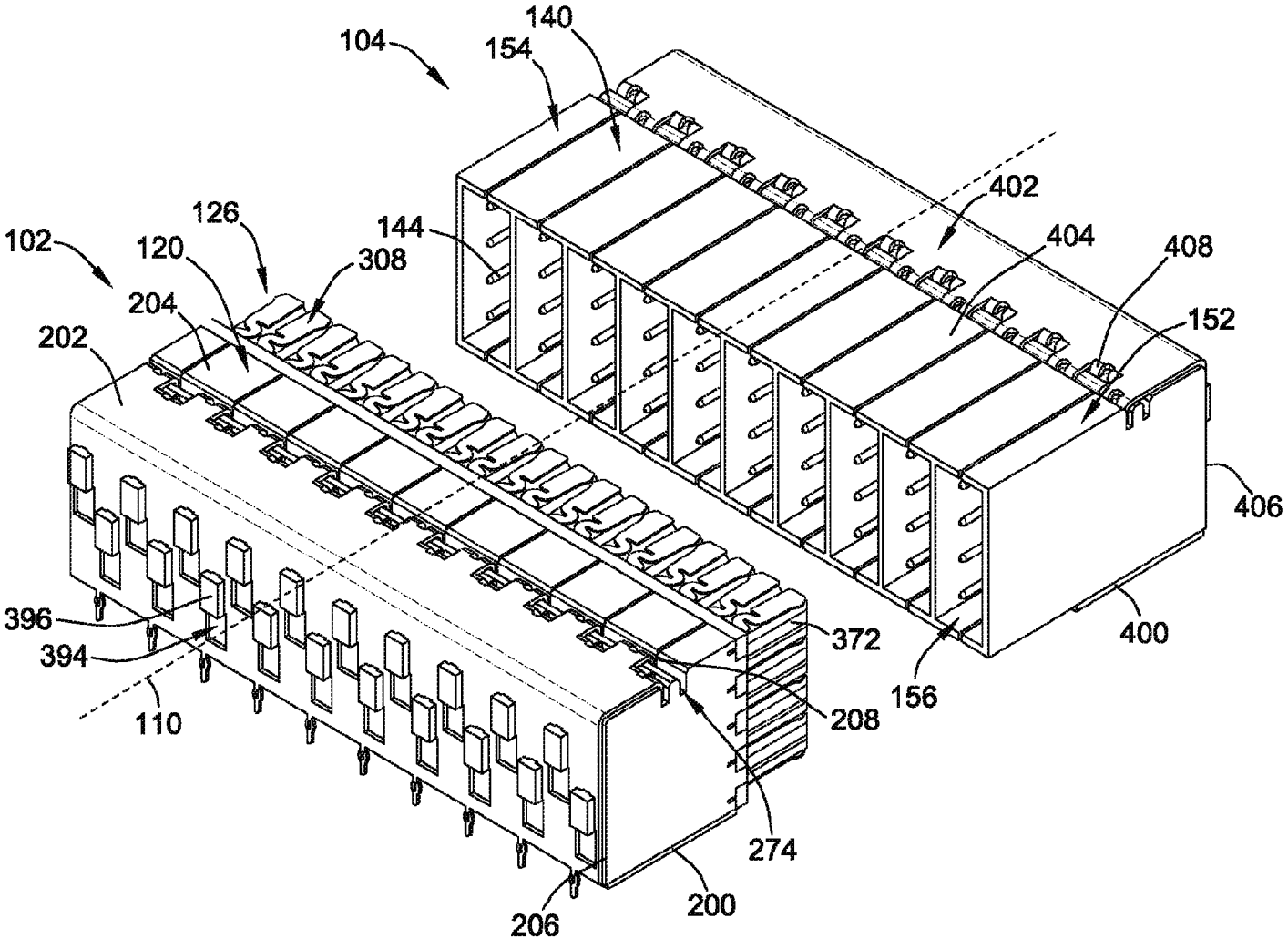
FIG. 9 illustrates the receptacle assembly being mated to the header assembly.

FIG. 9 illustrates the receptacle assembly 102 being mated to the header assembly 104. The retainer 202 is coupled to the holders 120 to secure the holders 120 together. The retainer 202 extends along the top 204 and the rear 206 of the holders 120. The fingers 208 extend into the slots 274 in the top 204 of the holders 120. The retainer 202 includes a plurality of keyways 394 that receive keys 396 of the holders 120. The keys 396 extend rearward from the rears 206 of the holders 120. During assembly, the retainer 202 is initially loaded onto the keys 396 and then slid downward to lock the keys 396 into the keyway. As the retainer is slid downward, the fingers 308 are loaded into the slots 274. Other securing features may be used in alternative embodiments to secure the retainer 202 to the holders 120.

The mating housing 126 extends forward from the holders 120 and is configured to be received in the loading chambers 156 of the header assembly 104. When assembled, the mating housing 126, and corresponding silos 372, are surrounded by the holders 140 of the header assembly 104. The holders 140 extend between the rows of silos 372, and thus provide shielding between the silos 372. The header assembly 104 provides electrical shielding for the mating housing 126. In an exemplary embodiment, the ground clips 380 engage the holders 140 to create an electrical connection between the receptacle assembly 102 and the header assembly 104. The spring arms 282 are configured to be biased against corresponding holders 140 of the header assembly 104 when loaded into the loading chamber 156.

Figure 10:
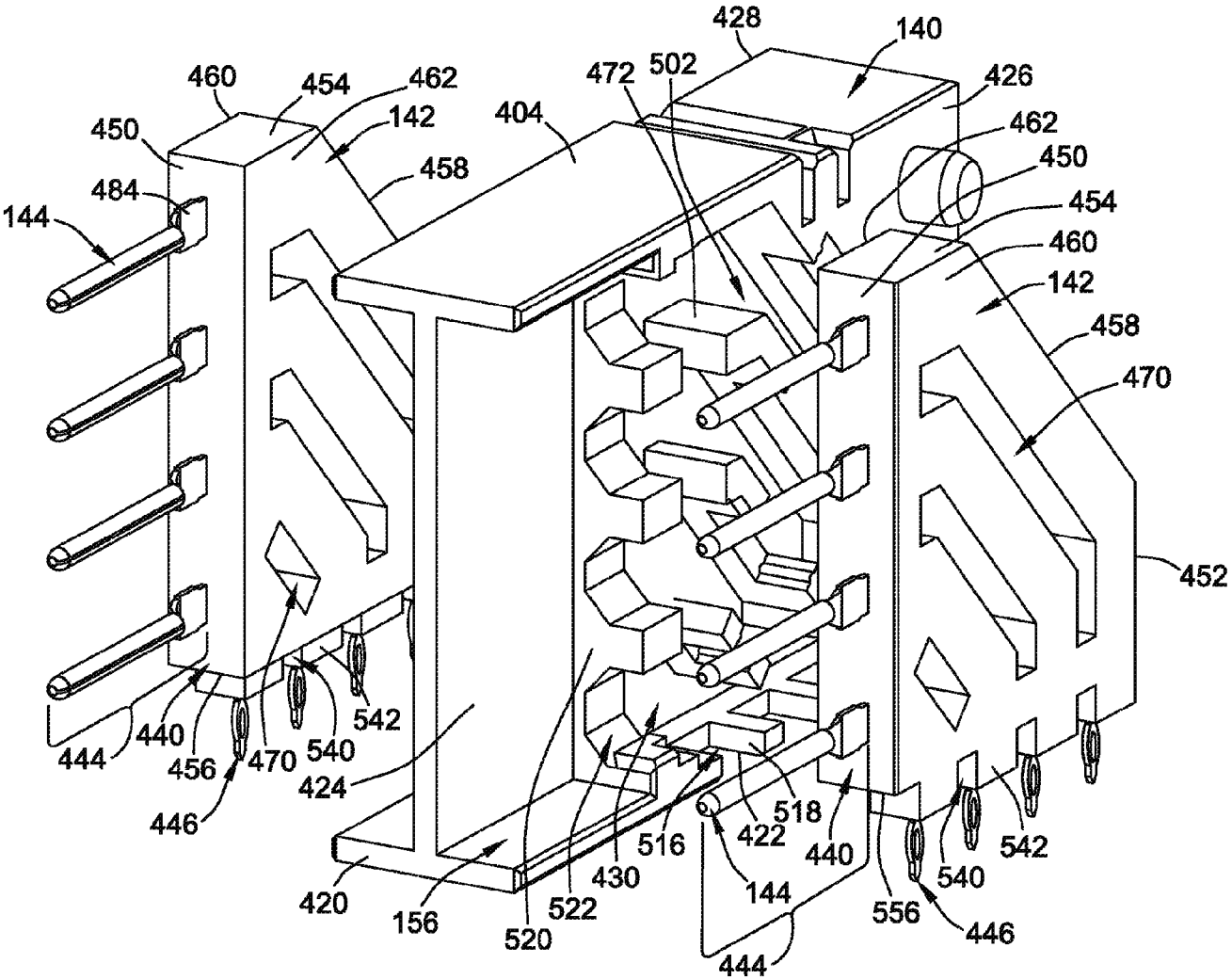
FIG. 10 is a front perspective view of a holder and contact modules for the header assembly.
Figure 11:
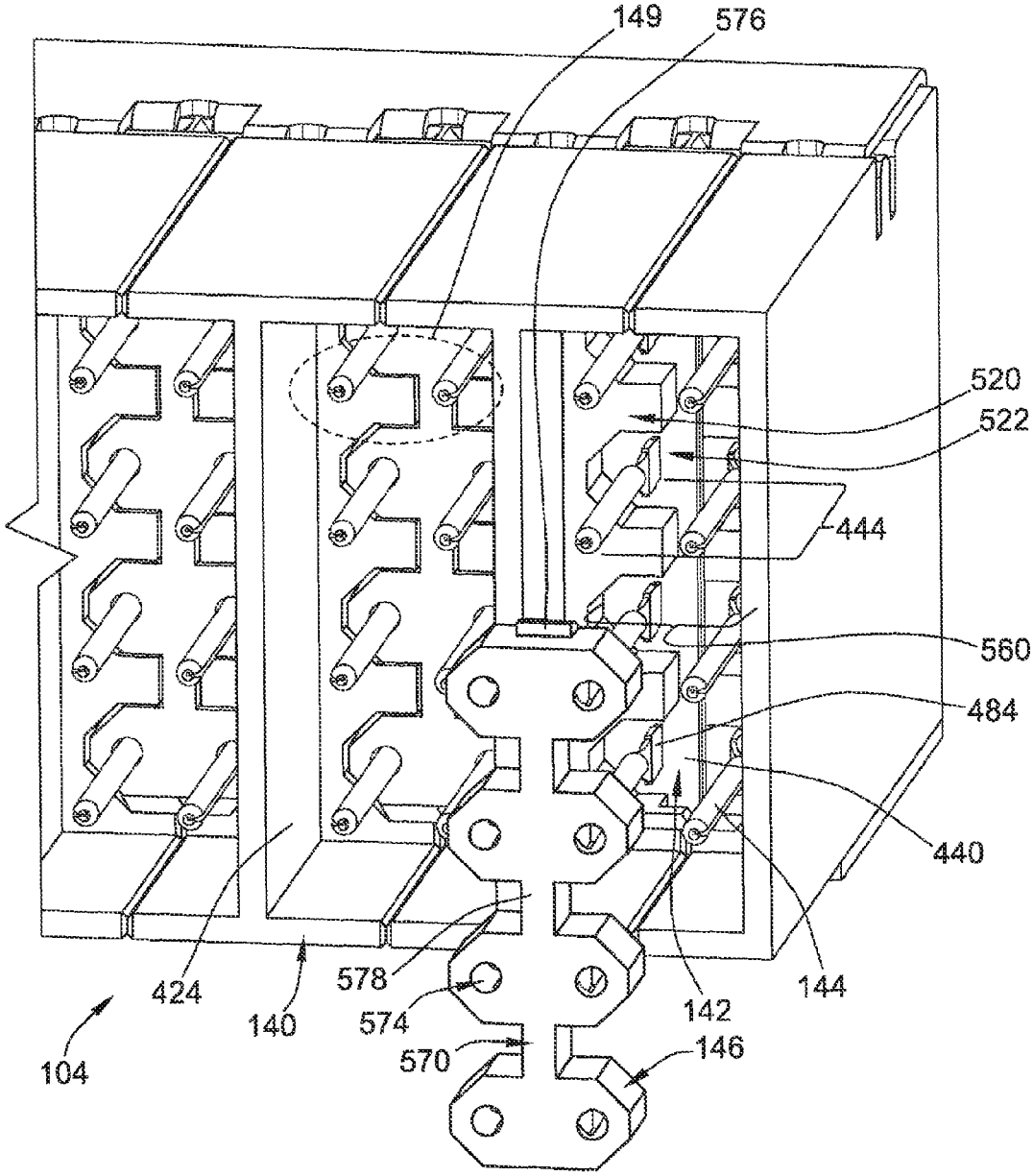
FIG. 11 is a partial exploded view of a portion of the header assembly showing a mating housing for the header assembly.

The header assembly 104 includes the holders 140 and end holders 152, 154, which hold a plurality of the contact modules 142 (shown in FIG. 10) and mating housings 146 (shown in FIG. 11). The contact modules 142 each include a plurality of the header contacts 144. The mating housings 146 support the header contacts 144 and electrically isolate the header contacts 144 from the holders 140. The header assembly 104 also includes a conductive gasket 400, which may be substantially similar to the conductive gasket 200. The conductive gasket 400 is configured to be mounted to the circuit board 108 (shown in FIG. 1). The conductive gasket 400 defines a ground path between the header assembly 104 and the circuit board 108.

The header assembly 104 includes a retainer 402 coupled to each of the holders 140. The retainer 402 secures each of the holders 140 together. The retainer 402 may be substantially similar to the retainer 202. The retainer 402 extends along a top 404 and a rear 406 of the holders 140. The retainer 402 includes a plurality of lingers 408 that engage the corresponding holders 140. The fingers 408 secure the relative positions of the holders 140.

FIG. 10 is a front perspective view of a portion of the header assembly 104 showing a plurality of contact modules 142 poised for assembly with a corresponding holder 140. The holder 140 includes a front 420 and a bottom 422 opposite the top 404. The holder 140 includes a body configured to support the contact modules 142. In the illustrated embodiment, each holder 140 supports two contact modules 142. More or less contact modules 142 may be supported by the holder 140 in alternative embodiments. In an exemplary embodiment, the holder 140 is fabricated from a conductive material. For example, the holder 140 may be die-cast from a metal material. Alternatively, the holder 140 may be stamped and formed or may be fabricated from a plastic material that has been metalized or coated with a metallic layer. By having the holder 140 fabricated from a conductive material, the holder 140 provides electrical shielding between and around the contact modules 142, such as from EMI, RFI, or other types of interference. When the holders 140 are ganged together, the holders 140 define the shield body 138 (shown in FIG. 1) of the header assembly 104.

The holder 140 includes a support wall 424. The support wall 424 is provided between the pair of contact modules 142. The support wall 424 provides shielding between the contact modules 142. Optionally, the support wall 424 may be substantially centrally located between opposite sides 426, 428 of the holder 140. The holder 140 includes a first header chamber 430 at the first side 426 and a second header chamber (not shown) at the second side 428. The first header chamber 430 and the second header chamber each receives one of the contact modules 142 therein. Alternatively, the first header chamber 430 and/or second header chamber may receive more than one contact module 142. In other alternative embodiments, only one header chamber is provided in the holder 140, with the header chamber receiving one, two or more contact modules 142 therein.

Each contact module 142 includes a dielectric body 440 surrounding the header contacts 144. The header contacts 144 may be formed to have a mating interface that is complementary to the receptacle contacts 124 for mating with the receptacle contacts 124. The header contacts 144 may initially be held together as a lead frame, which is overmolded with a dielectric material, and then a carrier of the lead frame removed to separate the header contacts 144 from one another. Other manufacturing processes may be utilized to form the contact modules 142 other than overmolding a lead frame.

Each of the header contacts 144 includes a mating portion 444 at one end thereof and a contact tail 446 at an opposite end thereof. The mating portions 444 constitute pin contacts having a generally cylindrical shape that is configured to be received within the barrel portions of the receptacle contacts 124. The contact tails 446 constitute press-fit pins, such as eye-of-the-needle contacts that are configured to be received in plated vias in the circuit board 108 (shown in FIG. 1).

The dielectric body 440 includes a front wall 450, a rear wall 452 generally opposite the front wall 450, a top wall 454 and a bottom wall 456 generally opposite the top wall 454. Optionally, the dielectric body 440 may include a slant wall 458 extending between the top wall 454 and the rear wall 452. The slant wall 458 is angled with respect to the top wall 454 and the rear wall 452. In an exemplary embodiment, the front and rear walls 450, 452 are parallel to each other and the top and bottom walls 454, 456 are parallel to each other and generally perpendicular with the respect to the front and rear walls 450, 452. The mating portions 444 of the header contacts 144 extend from the front wall 450 of the dielectric body 440. The contact tails 446 of the header contacts 144 extend from the bottom wall 456 of the dielectric body 440.

The dielectric body 440 includes a first side 460 and a second side 462 generally opposite the first side 460. The first and second sides 460, 462 are generally parallel to the sides 426, 428 of the holder 140. When assembled, the first and second sides 460, 462 may be generally coplanar with the sides 426, 428 of the holder 140.

The dielectric body 440 includes a plurality of windows 470 extending through the dielectric body 440 between the first and second sides 460, 462. The windows 470 are open between the first and second sides 460, 462 and are spaced apart from an outer perimeter of the dielectric body 440, which is defined by the front wall 450, rear wall 452, top wall 454, bottom wall 456 and slant wall 458. The windows 470 are internal of the dielectric body 440 and located between adjacent header contacts 144. For example, one or more windows 470 may be positioned between adjacent header contacts 144. The holder 140 includes tabs 472 that extend from both sides of the support wall 424. The tabs 472 may be similar to the tabs 272, 300 (shown in FIGS. 6 and 7). The tabs 472 extend into the windows 470 when the contact modules 142 are coupled to the holder 140. The tabs 472 form part of the shield body 138 and provide electrical shielding between adjacent header contacts 144. The tabs 472 support the contact modules 142 within the corresponding first header chamber 430 or second header chamber. In an exemplary embodiment, the tabs 472 are integrally formed with the support wall 424 and the other portions of the holder 140. The tabs 472 extend into the header chamber 430 such that channels 502 are formed on both sides of each tab 472. The channels 502 receive the dielectric body 440 of the respective contact module 142.

The bottom 422 of the holder MO includes a plurality of openings 516. Fingers 518 are provided between each of the openings 516. Portions of the contact modules 142 are received in the openings 516 when the contact modules 142 are loaded into the first header chamber 430 and the second header chamber. The fingers 518 are positioned between such portions of the contact modules 142 to provide electrical shielding between such portions of the contact modules 142. The bottom 422 also provides a surface for interfacing with the conductive gasket 400.

The holder 140 includes interior walls 520 (only one is shown in FIG. 10) having a plurality of cavities 522. The interior walls 520 are provided on both sides of the support wall 424 and extend along the front of the first header chamber 430 and second header chamber. The loading chambers 156 are defined forward of the interior walls 520. When the contact modules 142 are loaded into the first header chamber 430 and second header chamber, the front walls 450 abut against the interior walls 520. The mating portions 444 of the header contacts 144 extend through the cavities 522. When the holder 140 is positioned adjacent another holder 140, the interior walls 520 face each other and the cavities 522 are aligned with one another. Optionally, the interior walls 520 of adjacent holders 140 may be spaced apart from one another. Alternatively, the interior walls 520 of adjacent holders 140 may abut against one another. The mating housing 146 (shown in FIG. 11) is received in the cavities 522 of the adjacent holders 140.

During assembly, the contact modules 142 are loaded into the first header chamber 430 and second header chamber such that the tabs 472 are received in the windows 470. The bottom wall 456 of each contact module 142 includes a plurality of openings 540 that separate leg portions 542 of the dielectric body 440 at the bottom wall 456. The header contacts 144 extend through the leg portion 542 and the contact tails 446 extend outward from respective leg portions 542. When the contact modules 142 are loaded into the first header chamber 430 and second header chamber, the leg portions 542 are received in the openings 516 (only shown on the first side 426 of the holder 140). The fingers 518 (only shown on the first side 426 of the holder 140) are received in the openings 540 and are thus provided between the portions of the header contacts 144 extending through the leg portions 542. The fingers 518 provide shielding between such portions of the header contacts 144.

The mating portions 444 extend from the front wall 450. In the illustrated embodiment, carrier plates 484 are exposed beyond the front wall 450. When the contact modules 142 are loaded into the first header chamber 430 and second header chamber, the carrier plates 484 are positioned in the cavities 522. The interior wall 520 is positioned between the carrier plates 484 of adjacent header contacts 144, and thus provides electrical shielding therebetween.

Figure 12:
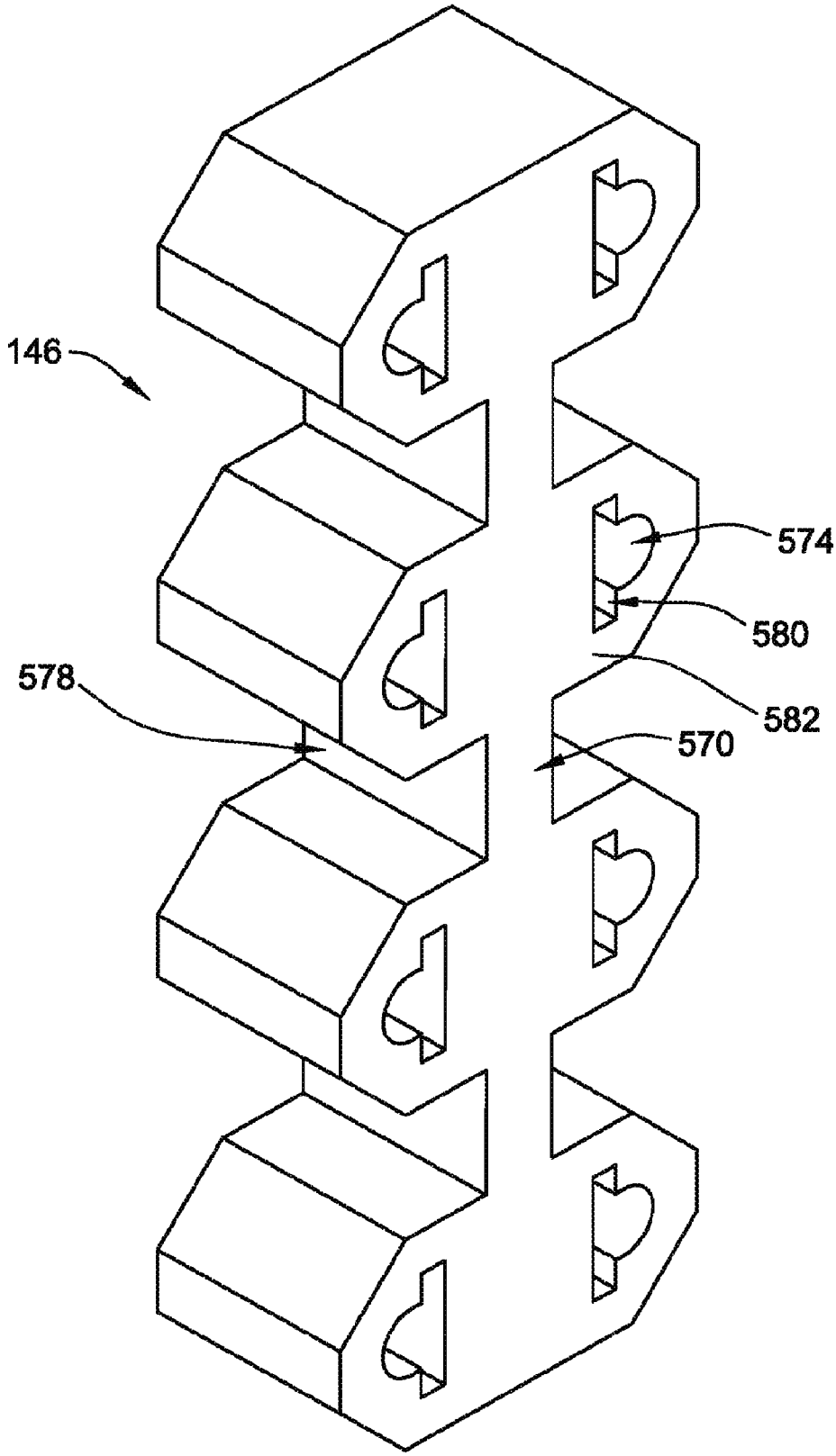
FIG. 12 is a rear perspective view of the mating housing of the header assembly.

FIG. 11 is a partial exploded view of a portion of the header assembly 104 showing one of the mating housings 146 poised for assembly into the holders 140. FIG. 12 is a rear perspective view of one of the mating housings 146. During assembly, after the contact modules 142 are loaded into the corresponding holder 140, the holders 140 (any number of which may be provided depending on the particular application) are ganged together and coupled to one another. The end holder 152 is provided at one of the ends and the other end holder 154 (shown in FIG. 9) is provided at the opposite end of the stack of holders 140. The end holder 152 includes one of the contact modules 142 therein.

In an exemplary embodiment, the contact modules 142 are arranged in contact module sets 560. Each contact module set 560 includes a plurality of the differential pairs 149 of header contacts 144. Each contact module set 560 includes two contact modules 142. One of the header contacts 144 of each differential pair 129 is held by one of the contact modules 142 and the other header contact 144 is held by the other contact module 142. The contact modules 142 within a particular contact module set 560 are arranged within different holders 140 (or end holders 154, 152) that are adjacent to each other. The contact modules 142 within a particular holder 140 form parts of different contact module sets 560. The contact module sets 560 are separated from adjacent contact module sets 560 by the support walls 424. The support walls 424 provide electrical shielding between adjacent contact module sets 560. The dielectric bodies 440 of the contact modules 142 are surrounded by the holders 140 such that the dielectric bodies 440 are electrically shielded. The mating portions 444 extend from the dielectric body 440 and are received in the respective mating housings 146. The mating housings 146 are coupled to the holders 140 to support the mating portions 444 and/or electrically isolate the mating portions 444 from the holders 140.

The mating housing 146 includes a base 570 that is configured to be mounted to the interior walls 520 of corresponding holders 140. The mating housing 146 is received in the cavities 522 formed in the interior walls 520. The mating housing 146 includes a plurality of contact channels 574 extending therethrough. The contact channels 574 receive the mating portions 444 of the header contacts 144 to support the header contacts 144. The base 570 includes a latch 576 that secures the mating housing 146 within the holders 140. The mating housing 146 spans across the interface between adjacent contact modules 142 within a contact module set 560. The interior walls 520 face each other and are spaced apart from each other. Connecting portions 578 of the mating housing 146 are received in the space between the interior walls 520.

As shown in FIG. 12, the contact channels 574 include notches 580 at a rear 582 of the mating housing 146. The notches 580 are configured to receive the carrier plates 484 of the header contacts 144.

Figure 13:
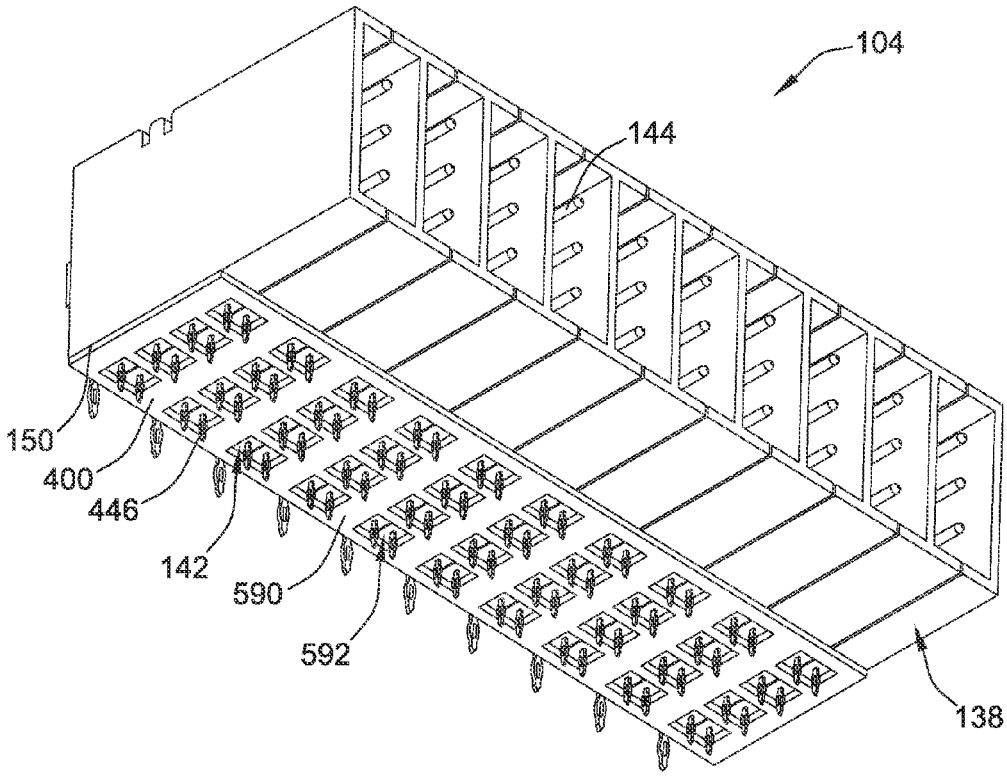
FIG. 13 is a bottom perspective view of the header assembly.

FIG. 13 is a bottom perspective view of the header assembly 104. The conductive gasket 400 is coupled to the mounting end 150 of the header assembly 104. The conductive gasket 400 includes a mounting surface 590 that is configured to be mounted to, and engage, the circuit board 108 (shown in FIG. 1). The conductive gasket 400 includes a plurality of openings 592. The contact tails 446 of the header contacts 144 extend from the contact modules 142 through respective openings 592. The contact tails 446 are configured to be received in conductive vias (not shown) of the circuit board 108 to make electrical connection to corresponding signal traces of the circuit board 108. In an exemplary embodiment, a pair of contacts tails 446 is provided within each opening 592. The conductive gasket 400 defines a ground path between the circuit board 108 and the shield body 138 of the header assembly 104. The conductive gasket 400 may be fabricated from a compressible material that is compressed when the header assembly 104 is mounted to the circuit board 108.

Figure 14:
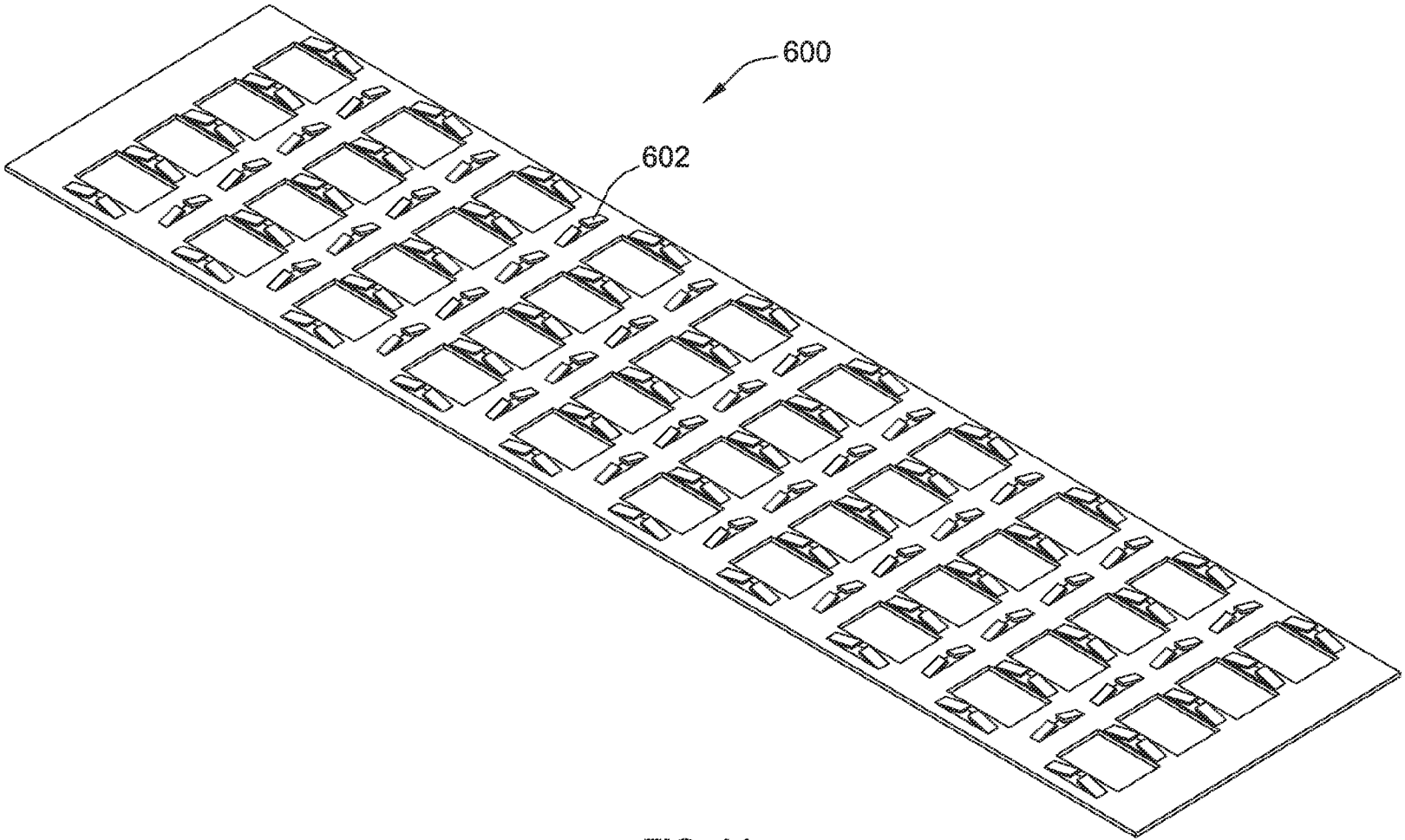
FIG. 14 illustrates an alternative conductive gasket for the header assembly.

FIG. 14 illustrates an alternative conductive gasket 600 for the header assembly 104 (shown in FIG. 1) or the receptacle assembly 102 (shown in FIG. 1). The conductive gasket 600 may be similar to the conductive gasket described in concurrently filed U.S. Patent Application titled GROUND INTERFACE FOR A CONNECTOR SYSTEM, Ser. No. 12/790,042, the complete subject matter of which is herein incorporated by reference in its entirety.

The conductive gasket 600 is stamped and formed. The conductive gasket 600 includes a plurality of spring fingers 602 that are bent out of plane with respect to the conductive gasket 600. The spring fingers 602 are configured to engage the header assembly 104 (or the receptacle assembly 102). Optionally, at least some of the spring fingers 602 may be bent upward and some of the spring fingers 602 may be bent downward to engage both the header assembly 104 and the circuit board 108 (or the receptacle assembly 102 and the circuit board 106). Any number of spring fingers 602 may be provided. Having multiple spring fingers 602 creates multiple points of contact to the header assembly 104 and/or the circuit board 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

discrete contact modules, each contact module having a dielectric body and contacts held by the dielectric body, the dielectric body having generally parallel sides, the dielectric body includes windows extending from at least one of the sides at least partially through the dielectric body, the windows being located between adjacent contacts; and discrete conductive holders supporting corresponding contact modules, the holders being coupled together such that the contact modules are stacked parallel to one another, the holders being electrically grounded, the holders each having a support wall and tabs extending outward from the support wall, the contact modules being coupled to the holders such that one of the sides of the dielectric body extends along the support wall and such that the tabs are received in the windows to provide internal shielding within the contact modules between the sides of the dielectric body and between corresponding contacts of the contact modules.

2. The connector assembly of claim 1, wherein the holders are fabricated from a material that provides electrical shielding, the support walls and tabs providing electrical shielding between corresponding contacts of the contact modules.

3. The connector assembly of claim 1, wherein the contacts are held by the holders and arranged as differential pairs with each differential pair being surrounded by corresponding support walls and tabs of corresponding holders, the holders are fabricated from a material that provides electrical shielding, the support walls and tabs providing electrical shielding between each of the differential pairs of contacts.

4. The connector assembly of claim 1, wherein the dielectric body has an outer perimeter between the sides, the windows being open between the sides and being spaced apart from the outer perimeter.

5. The connector assembly of claim 1, wherein the windows extend along a majority of the length of the adjacent contacts.

6. The connector assembly of claim 1, wherein the holders are coupled together such that tabs of adjacent holders are interdigitated with the tabs of one holder being at least partially received in the windows of the contact module held by the adjacent holder.

7. The connector assembly of claim 1, further comprising a retainer coupled to a plurality of the holders, the retainer joining the plurality of the holders together, the retainer being electrically commoned with each of the plurality of the holders.

8. The connector assembly of claim 1, wherein each of the holders supports multiple contact modules on a common side of the support wall.

9. The connector assembly of claim 1, wherein the support wall of each holder includes a first side and a second side, the tabs extending from the support wall extend from both the first side and from the second side, the holder supports one of the contact modules on the first side and one of the contact modules on the second side.

10. The connector assembly of claim 1, wherein the contact modules are arranged in contact module sets with two contact modules in each contact module set, the contacts being arranged in differential pairs with the contacts of each differential pair being arranged in different contact modules of the corresponding contact module set, the holders being ganged together such that the support walls of adjacent holders flank the corresponding contact module sets.

11. The connector assembly of claim 1, wherein the contact modules are arranged in contact module sets with two contact modules in each contact module set, the contacts being arranged in differential pairs with the contacts of each differential pair being arranged in different contact modules of the corresponding contact module set, the holders being ganged together such that the support walls of adjacent holders flank the corresponding contact module sets, wherein the holders provide circumferential shielding around each differential pair along the length of the contacts in the differential pair with the support walls along sides of the contacts and with the tabs along a top and a bottom of the contacts.

12. A connector assembly comprising:

contact modules each having a dielectric body having a mating end and a mounting end, the contact modules including contacts having mating portions extending from the mating end, the dielectric body includes windows extending through the dielectric body and located between adjacent contacts;

holders supporting corresponding contact modules, the holders being electrically grounded, the holders each having a support wall and tabs extending outward from the support wall, the contact modules being coupled to the holders such that the tabs are received in the windows to support the contact modules with respect to the holders, the tabs providing shielding within the contact modules, wherein the holders are coupled together such that the contact modules are stacked parallel to one another; and a mating housing coupled to the mating ends of adjacent contact modules such that the mating housing spans across the mating ends of the adjacent contact modules, the mating housing having contact channels receiving the mating portions of corresponding contact modules.

13. The connector assembly of claim 12, wherein the mating housing is positioned between support walls of adjacent holders such that the mating housing engages two contact modules.

14. The connector assembly of claim 12, wherein the mating housing engages each of the contact modules to support mating portions of each of the contact modules.

15. The connector assembly of claim 12, further comprising a plurality of ground clips coupled to the mating housing between corresponding contact channels, the ground clips are electrically connected to corresponding holders and providing electrical shielding between the mating portions of the contacts received in the contact channels.

16. The connector assembly of claim 12, wherein the contact modules are stacked parallel to one another such that the contacts are arranged in rows and columns, the contact modules being arranged in contact module sets with two contact modules in each contact module set, the contact module sets being separated from one another by support walls of corresponding holders.

17. The connector assembly of claim 12, wherein the contact modules are arranged in contact module sets with two contact modules in each contact module set, the contacts being arranged in differential pairs with the contacts of each differential pair being arranged in different contact modules of the corresponding contact module set, the holders being ganged together such that the support walls of adjacent holders flank the corresponding contact module sets, the connector assembly further comprising ground clips coupled to the mating housing between adjacent differential pairs of contacts within each contact module set.

18. The connector assembly of claim 12, further comprising ground clips coupled to the mating housing between corresponding contact channels, the ground clips having spring arms configured to be biased against corresponding holders of a mating connector assembly, the ground clips being electrically connected to the corresponding holders of the mating connector assembly when engaged thereto.

19. A connector system comprising:

a header assembly comprising header holders and header contact modules supported by the header holders, each header contact module having a dielectric body and contacts, each header holder having a support wall and outer walls extending from the support wall to define at least one header chamber, each header chamber receiving a corresponding header contact module, the header chamber being electrically shielded by the support wall and outer walls, the header holders being coupled together such that the header contact modules are stacked parallel to one another, the header holders defining a loading chamber at a front end of the header assembly; and a receptacle assembly comprising receptacle holders and receptacle contact modules supported by the receptacle holders, each receptacle contact module having a dielectric body and contacts, each receptacle holder having a support wall and outer walls extending from the support wall to define at least one receptacle chamber, each receptacle chamber receiving a corresponding receptacle contact module, the receptacle chamber being electrically shielded by the support wall and outer walls, the receptacle holders being coupled together such that the receptacle contact modules are stacked parallel to one another, the receptacle assembly having a mating housing at a front end of the receptacle assembly, the mating housing having contact channels receiving the contacts of the receptacle contact module.

20. The connector system of claim 19, wherein the contacts of the header assembly are arranged as differential pairs and the contacts of the receptacle assembly are arranged as differential pairs, the support walls of the receptacle and header holders are positioned between corresponding differential pairs of contacts to provide shielding therebetween.

* * * * *